US006574927B2

(12) United States Patent
Van Parys

(10) Patent No.: US 6,574,927 B2
(45) Date of Patent: Jun. 10, 2003

(54) FITTING FOR A WINDOW AND PARTS FOR SUCH FITTING

(76) Inventor: Remi Emiel Van Parys, Zultseweg 120, B-8790 Waregem (BE)

( * ) Notice: Subject to any disclaimer, the term of this patent is extended or adjusted under 35 U.S.C. 154(b) by 0 days.

(21) Appl. No.: 10/058,018

(22) Filed: Jan. 29, 2002

(65) Prior Publication Data

US 2002/0100233 A1 Aug. 1, 2002

(30) Foreign Application Priority Data

Jan. 29, 2001 (BE) ..... 2001/0068

(51) Int. Cl.[7] ..... E06B 3/32

(52) U.S. Cl. ..... 52/204.51; 52/204.56; 52/204.69; 52/204.72

(58) Field of Search ..... 52/204.51, 204.56, 52/204.67, 204.69, 204.7, 204.72; 49/158, 162, 174, 175, 190

(56) References Cited

U.S. PATENT DOCUMENTS 5,444,958 A * 8/1995 Lu ..... 52/775
5,483,779 A * 1/1996 Crawford et al. ..... 52/775

FOREIGN PATENT DOCUMENTS

| | | |
|---|---|---|
| AT | 331145 | 10/1975 |
| DE | G7223874 | 10/1972 |
| DE | 2 142 085 | 3/1973 |
| DE | 28 05 465 | 8/1979 |
| EP | 0 167 386 | 1/1986 |
| EP | 0 560 016 | 9/1993 |
| EP | 0 668 427 | 8/1995 |

* cited by examiner

*Primary Examiner*—Carl D. Friedman
*Assistant Examiner*—Yvonne M. Horton
(74) *Attorney, Agent, or Firm*—Bacon & Thomas, PLLC

(57) ABSTRACT

A fitting adapted for a window with a frame and a wing connected to the frame by at least one hinge. The fitting includes a carrier piece that cooperates with an edge of the wing and an edge of the fixed frame, and a plurality of laths engaging the carrier piece in a shiftable fashion along the edge of the wing. The carrier piece defines at each end portion thereof a toothed profile configured and dimensioned to mutually engage a toothed profile defined at each end portion of the laths.

10 Claims, 19 Drawing Sheets

22
13
VI
VI
3
IV
IV
23
23
V
V
22
21
13

13
22
22
23
20
3
23
22
21
13

FITTING FOR A WINDOW AND PARTS FOR SUCH FITTING

BACKGROUND OF THE INVENTION

1. Field of the Invention

This invention relates to a fitting for a window with a fixed frame and a wing, which fitting comprises at least one carrier piece which is shiftably attached to an edge of the wing, the fixed frame, respectively, in a fitting groove, and to laths which can be displaced by this carrier piece, which laths can be shifted in a fitting groove on said edge and possible on other edges of the wing or the fixed frame, of which at least a number are provided with at least one pin which cooperates with a closing part attached to the fixed frame, the wing, respectively.

The locking and unlocking of such window is commanded by a handle attached to the wing or the fixed frame, which handle engages with a portion into the carrier piece in order to displace it.

However, the windows have different dimensions, such that the lengths of the laths may differ from window to window.

2. Discussion of the Related Art

With known fittings, these laths are extruded profiled stiles of aluminum which are sawn to size by the window manufacturer, in function of the dimensions of the window and the position of the handle, and which subsequently are bored or punched in order to form openings which are necessary to couple them, by means of pins, to the carrier piece and possibly together or to other parts.

The sawing to size of the laths and the boring or punching of the openings is very time-consuming for the manufacturer and requires relatively expensive machines, such that the manufactured laths are relatively expensive.

In the first place, this is the case if laths are not only present along the edge where the carrier piece is situated, but also along an edge directed perpendicular thereto, whereby laths are connected by means of a corner connection.

This is the case, for example, with a turn and tilt window.

A turn and tilt window comprises a wing which can hinge at one upright side of the fixed frame as well as tilt at the underside.

The transition from tilting to turning or reverse is also commanded by the handle which is attached to the wing and engages into the carrier piece which is shiftably provided on an upright edge of the wing. This carrier piece is connected, by means of laths, to a tilting pin at the underside and, by means of laths and a corner connection, connected to a scissors mechanism which is mounted between the wing and the fixed frame.

This means that at least along the edge with the carrier piece and between the corner connection and the scissors mechanism, the laths must have a well-defined length, and the sawing of the laths then must be performed very precisely.

SUMMARY OF THE INVENTION

The present invention aims at providing a fitting, the laths of which no longer have to be sawn to size and punched by the manufacturer and which thus can be placed faster on a window, and whereby the laths are less expensive.

According to the invention, this aim is achieved in that, in a first form of embodiment, the carrier piece, with each of its extremities, is coupled to a lath by means of mutually engaging toothed parts, to wit a toothed part at the extremity of the lath and a toothed part at the extremity of the carrier piece.

By having the toothed parts mutually overlap to a major or minor extent, the overall length of the laths along an edge can be pre-set. Thus, the laths also can be manufactured beforehand at the company's premises, with a number of standard sizes.

The length of the toothed parts is at least 5 cm, and preferably at least 6 cm.

In order to have the toothed parts mutually engage with the desired overlapping in an easy manner, the carrier piece preferably is provided with springy legs, with which it is snapped into the fitting groove.

The laths first can be slid in the fitting groove into the desired position, after which the carrier piece is snapped onto this fitting groove, such that the toothed parts mutually engage.

According to a second form of embodiment, said aim is achieved in that a punching screw is screwed into each extremity of the carrier piece, and that the lath coupled to this extremity is slid with one en d into the fitting groove underneath said extremity of the carrier piece and the punching screw is screwed into or through this extremity of the lath.

As long as the punching screw is not screwed into the lath, the lath can be slid deeper or less deep under the carrier piece. Thus, the length of the laths along an edge can be adjusted, as a result of which the laths can be delivered beforehand by the manufacturer with a standard length. Beforehand, these laths need not have any openings for the coupling.

This form of embodiment with a punching screw is recommended in the first place when a burglary delay is desired.

The carrier piece preferably comprises a rib at one side and at the other side a groove which are slidably provided under, over, respectively, an edge of the fitting groove. In its side directed towards the bottom of the fitting groove, the carrier piece may comprise a recess for a flat extremity of a lath, which, for example, may comprise beveled edges.

In both forms of embodiment, the possible adjustment in the longitudinal direction of each coupling is, for example, 50 mm, such that in the longitudinal direction of the laths, a difference in length of 100 mm can be taken up.

In both forms of embodiment, the laths coupled to the carrier piece also can be provided with a toothed part at1their extremity distant from this latter, which toothed parts engages into a complementary toothed part of a part, for example, another lath, the movable part of a corner connection or the like.

In consideration of the fact that these toothed parts do not have to be used for an adjustment in length, they may be shorter and have larger teeth then the aforementioned toothed parts.

One of the mutually engaging toothed parts may be provided at the inner side of a hollowed thickened extremity, the other toothed part, for example, on a narrowed extremity.

Thus, the fitting may comprise one or more laths which are provided with a toothed part on both extremities, whereby these toothed parts may be complementary or equal.

In both forms of embodiment, the carrier pieces and the laths may be manufactured of synthetic material, for example, polyamide, preferably reinforced by fibers, such as glass fibers.

As a result thereof, the laths and other parts can be manufactured in a relatively inexpensive manner, for example, by injection molding.

The fitting may extend over more than one edge of the window, in which case it comprises at least one corner connection with a fixed part and a part which is movable therein, whereby an extremity of the movable part is connected to an extremity of the lath in the fitting groove by means of mutually engaging toothed parts.

A corner connection which, with a part, is situated on the same edge as the carrier piece, can be coupled to a lath along an edge standing perpendicularly thereupon by means of similar toothed parts as those by which the carrier piece is coupled to a lath, according to said first form of embodiment.

The fitting of a window, amongst others, the fitting according to any of the aforementioned forms of embodiment, can comprise a ramp-forming part which is provided at the fixed frame.

With known windows and known fittings, this ramp-forming part is fixed on the window with a screw, which is time-consuming.

The invention aims at enabling a faster mounting of the ramp-forming part.

According to the invention, this aim is realized in that the ramp-forming part is snapped onto the fixed frame and, to this aim, comprises at least one springy leg which, with a small edge, engages under a small edge of a fitting groove on the fixed frame.

This ramp-forming part may be manufactured of synthetic material, for example, polyamide, possibly reinforced by fibers, such as glass fibers.

The fitting may comprise a locking part which is fixed on an upstanding edge of the fixed frame and which, with its lower extremity, sits in an opening which is provided in the ramp-forming part in order to prevent the shifting of this snapped-on ramp-forming part.

With a turn and tilt window, the ramp-forming part also is provided with at least one opening for a shiftable hinge pin which is coupled to the carrier piece, preferably by the intermediary of laths which are coupled to this carrier piece and to each other in the above-described manner.

With a turn and tilt window, usually at the corner connection above the carrier piece, a securing system is provided in order to prevent a shifting of this carrier piece when the window is tilted or turned open.

This securing system comprises a lever which is fixed in a hinging manner on an extremity of the fixed portion of the corner connection.

With known securing systems, this lever is attached on the fixed portion by a rivet, as a result of which construction and mounting are relatively difficult.

The invention also has as an aim to provide for such securing system which is simple in respect to construction and mounting.

To this aim, according to the invention, the fixed portion of the corner connection has at one extremity a head portion which, at the side directed towards the movable part, comprises an opening, whereas the lever, at the one side, has a pin which is provided in this opening and, at the other side, at a distance from the turning axis, has a locking pin which, for one position of the lever, becomes situated between locking pins on the movable part of the corner connection, when the wing is open, however, which is situated outside of the path of these locking pins when the wing is closed, and whereby the pin is surrounded by a spring which pushes the lever towards the above-mentioned position.

The invention also relates to the parts, amongst others, the carrier piece, the laths and such, which are destined for forming part of a fitting according to any of the preceding forms of embodiment and which can be brought onto the market separately.

BRIEF DESCRIPTION OF THE DRAWINGS

With the intention of better showing the characteristics of the invention, hereafter, as an example without any limiting character, several preferred forms of embodiment of a fitting and of parts for such fitting according to the invention are described, with reference to the accompanying drawings, wherein:

FIG. 22 schematically represents a pivot-hung window, also with indication of the parts of the fitting;

DESCRIPTION OF PREFERRED EMBODIMENTS

Figure 1:
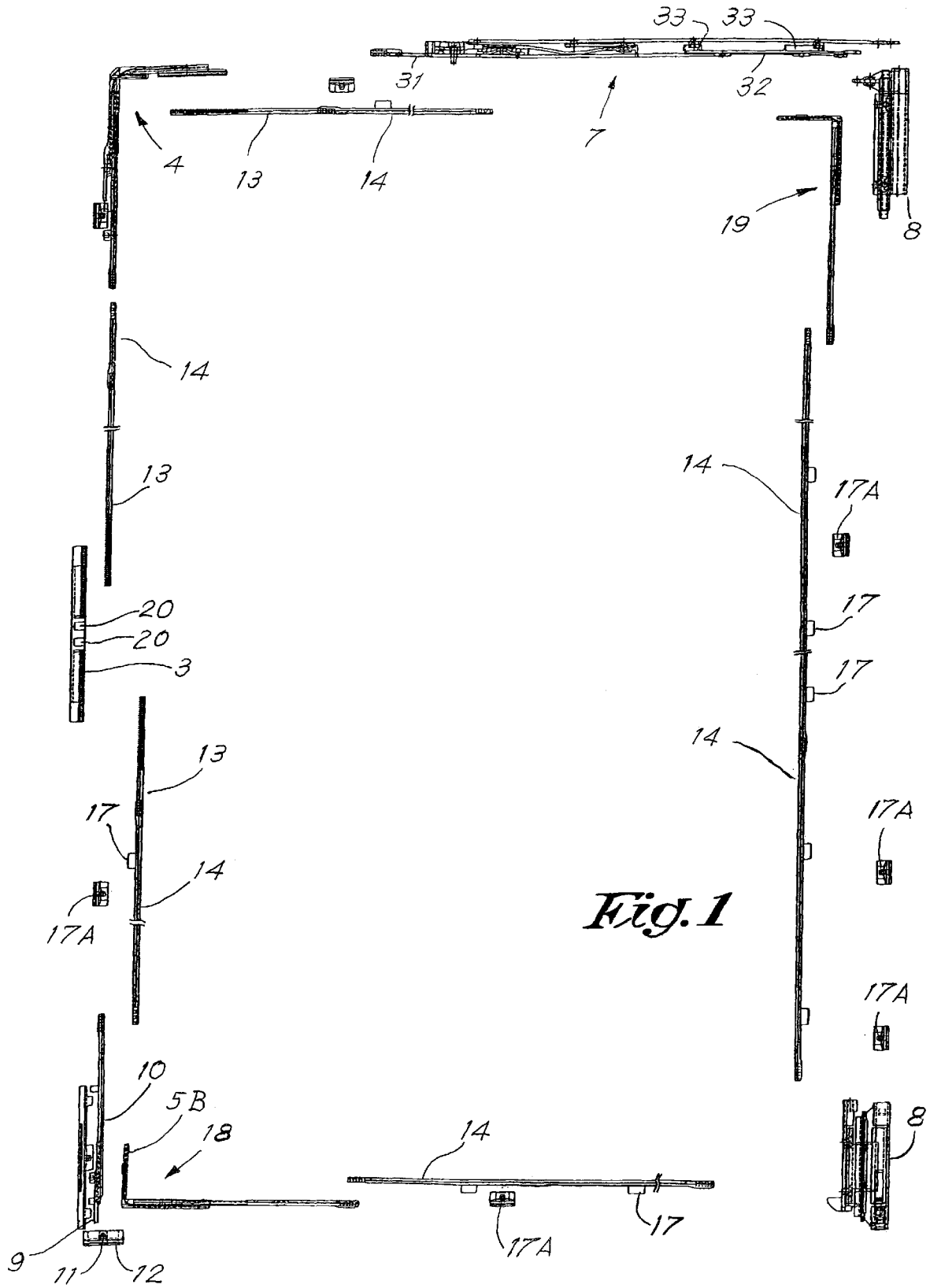
FIG. 1 schematically represents the fitting according to the invention of a turn and tilt window, with the majority of the parts taken apart.
Figure 2:
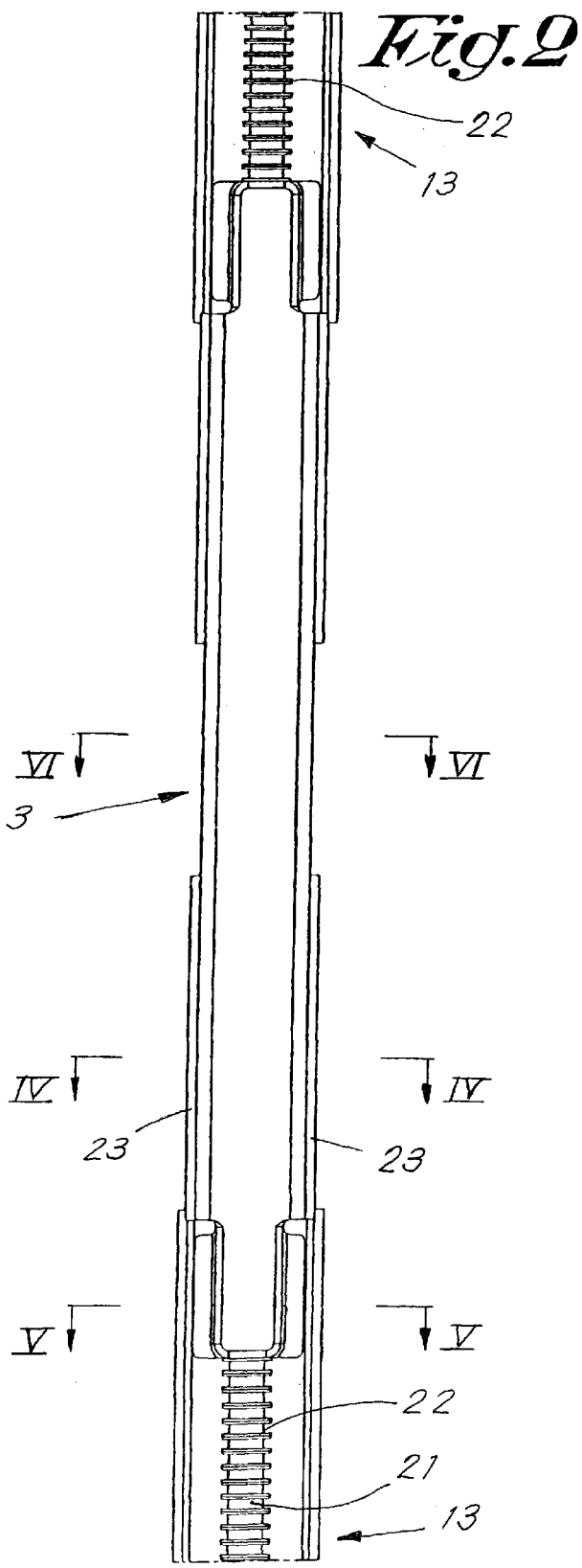
FIGS. 2 and 3 represent perspective views of the carrier piece and the extremities, to be coupled thereto, of laths from the fitting of FIG. 1, before and after coupling, respectively.
Figure 3:
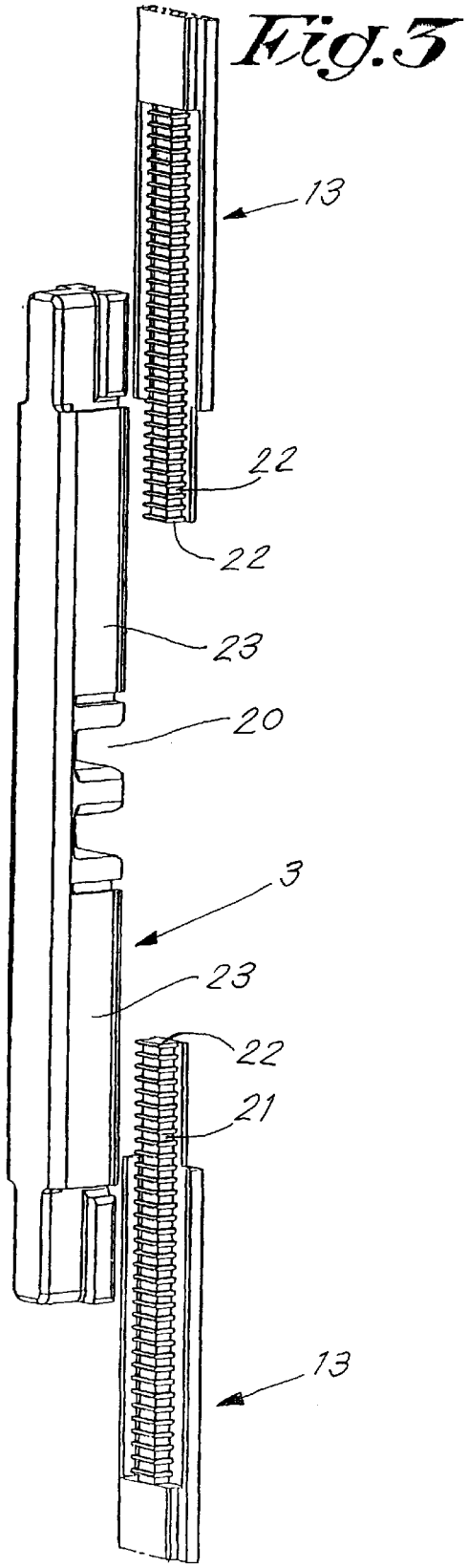

The fitting for a turn and tilt window consisting of a fixed frame 1 and a wing 2, which schematically is represented in FIG. 1 (without the frame 1 and the wing 2), substantially comprises a number of parts, to wit, a carrier piece 3 which is shiftably attached to an upstanding edge of the wing 2, a corner connection 4 situated thereabove with a movable part 5 which is pliable and can be displaced in a fixed gutter-shaped part 6 which forms a corner of 90° and is fixed on the wing 2, a scissors mechanism 7 which is provided at the top of the window, between the frame 1 and the wing 2, more particularly a part of the upper hinge 8, and a hinge pin 9 which is provided below the carrier piece 3, at the bottom, on a lath 10 and which, in tilting position of the wing 2, penetrates into an opening 11 of a ramp-forming part 12 which is fixed on the lower horizontal part of the fixed frame 1.

Figure 6:
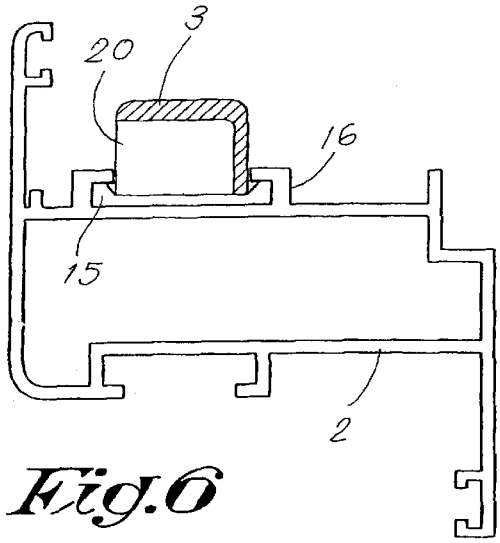
FIGS. 4 to 6 represent cross-sections according to the lines IV—IV, V—V and VI—VI in FIG. 2, with a part of a wing.
Figure 4:
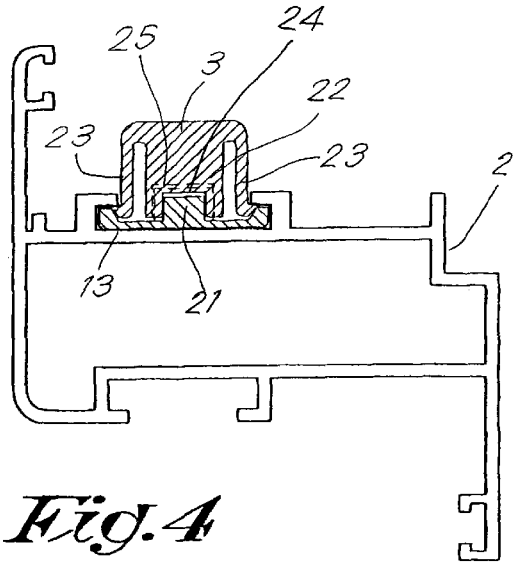
Figure 5:
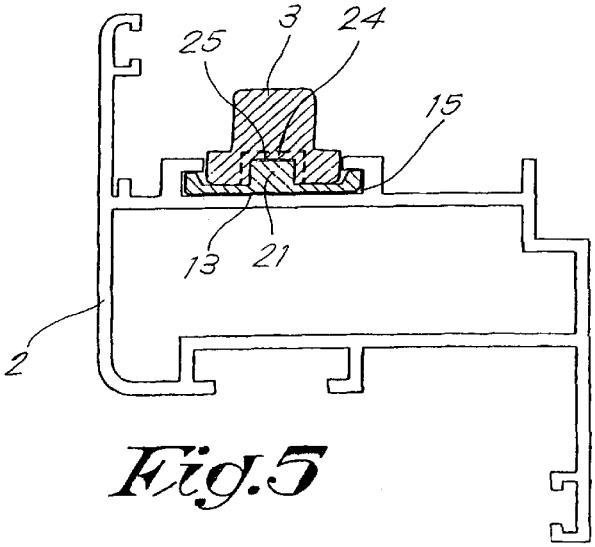

The aforementioned parts are connected to each other by means of laths 13 or 14 which can be shifted in fitting grooves 15 which are provided on the profiles of the wing 2 and, as represented in the cross-sections of, amongst others, FIGS. 4 to 6, are formed by two parallel ribs 16 which are bent towards each other with their outermost edges, such that grooves 16A are formed between these edges and the remainder of the profiled stile. These fitting grooves 15 extend over the entire length of the edges of the wing 2.

The laths 13 are adjustment laths and the laths 14 are connection laths. They are of a different type, as will be described in the following, with different lengths in each type. Depending on the type, the ends are different, however, between the ends the laths are having the same cross-section, which is equal to a reversed T. At opposite sides, the head sits in the grooves 16A, whereas the stem of the T is situated between the edges of the ribs 16 directed towards each other.

At least at a number of the laths 13 and 14, pins 17 are provided which can engage behind locking parts 17A which are attached to the fixed frame 1.

In the represented example, also at the underside and the side of the hinges 8 of the window closing points are present, such that the fitting also has laths 14 with pins 17 at said sides, a corner connection 18 next to the hinge pin 9, and a corner connection 19 next to the upper hinge 8. The lower hinge 8 is of a type known in itself, whereby a rotation around a vertical as well as around a horizontal axis is possible.

As represented in detail in FIGS. 2 to 6, the carrier piece 3 is a small elongated block which, with each of its extremities, is connected to a lath 13, in a manner which allows an adjustment in longitudinal direction, as long as the carrier piece 3 is not provided on the profiled stile of the wing 2.

This carrier piece 3 has two recesses 20 in its center which give out to the side of the two laths 13 connected thereto and in the side wall of the carrier piece 3 standing thereupon and which serve for receiving the two legs of the fork of the handle, not represented in the figures, for operating the fitting.

The two laths 13 have an extremity where the uppermost part, this is the part directed away from the bottom of the fitting groove 15, is cut away over approximately 7 centimeters and is replaced by a middlemost rib 21 which is provided with a toothed part 22 in the shape of corrugations distributed at regular interspaces, which extend over the exterior side and the longitudinal sides of the rib 21. On the last two centimeters, the lath 13 is narrowed in transverse direction, too.

The toothed part 22 has a length larger than 5 cm, preferably larger than 6 cm, and which in the example is approximately seven centimeters.

Between the recesses 20 and up to a distance from each end, the carrier piece 3 at opposite sides has a springy leg 23, the edge of which shows a laterally protruding small edge which, when the carrier piece 3 is snapped into the fitting groove 15, engages under the bent edges of the two ribs 16, on the extremities on top of the lower part of an extremity of a lath 13.

Over a distance of approximately seven centimeters, each extremity of the carrier piece 3 is provided with a recess 24, which fits over the rib 21 and which is provided with a toothed part 25 which is complementary to the toothed part 22 of a lath 13. The toothed part 25 also consists of corrugations which extend at regular mutual interspaces over the bottom and the side walls of the recess 24, and the overall length of the toothed part 25 ,is larger than 5 cm, preferably larger than 6 cm, and in the represented example is approximately seven centimeters.

When the carrier piece 3 is snapped with its legs 23 into a fitting groove 15, the toothed part 25 on each extremity engages into a toothed part 22 of a extremity of a lath 13 situated below, and this lath 13 is firmly connected to the carrier piece 3. The toothed parts 22 and 25 overlap each other to a major or minor, extent, depending whether the lath 13, when snapping on the carrier piece 3, is situated further or less far underneath the carrier piece 3, such that an adjustment in longitudinal direction of approximately five centimeters at each extremity is possible.

The opposed extremity of each lath 3 which is not provided with a toothed part 22, also is provided with a toothed part 26 which, however, is different and considerably shorter.

Figure 9:
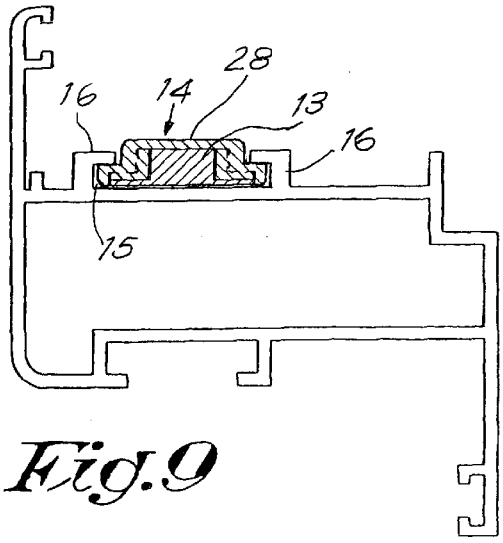
FIG. 9 represents a cross-section according to line IX—IX in FIG. 7, however, with a part of the wing.
Figure 7:
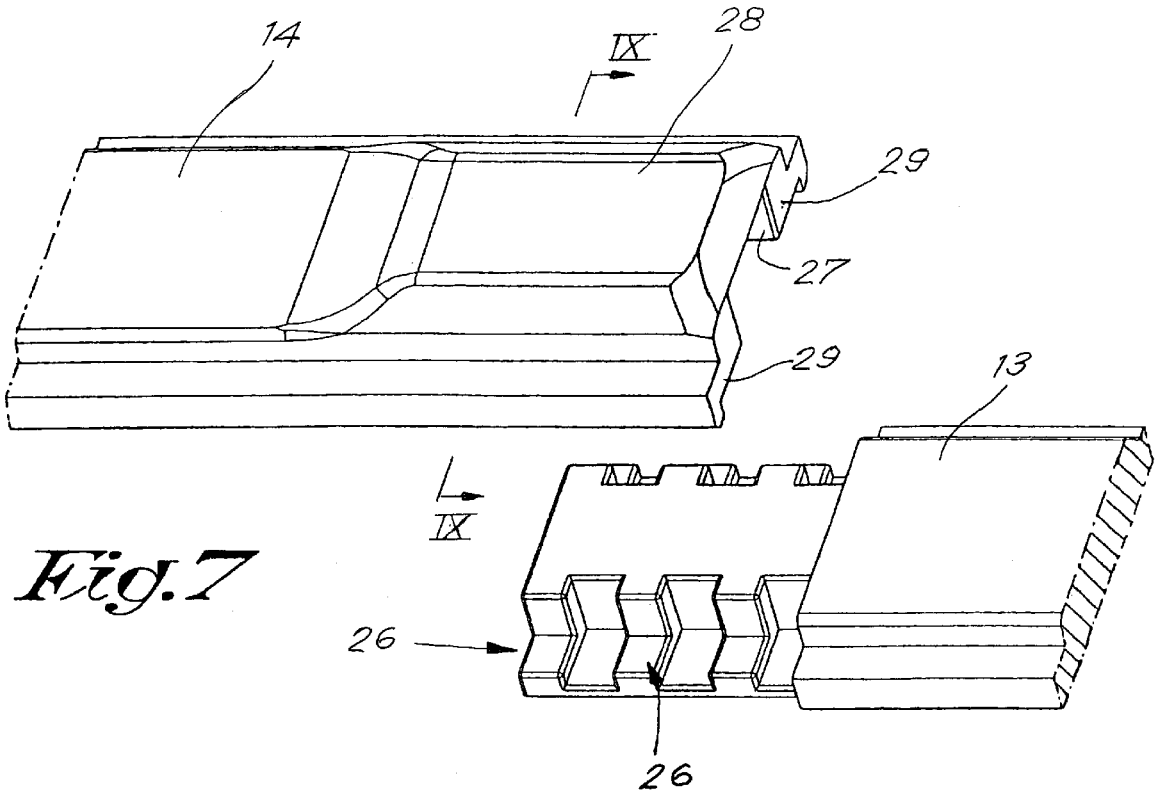
FIGS. 7 and 8 represent perspective views of the cooperating extremities of two laths of the fitting, viewed from the top, the bottom, respectively.
Figure 8:
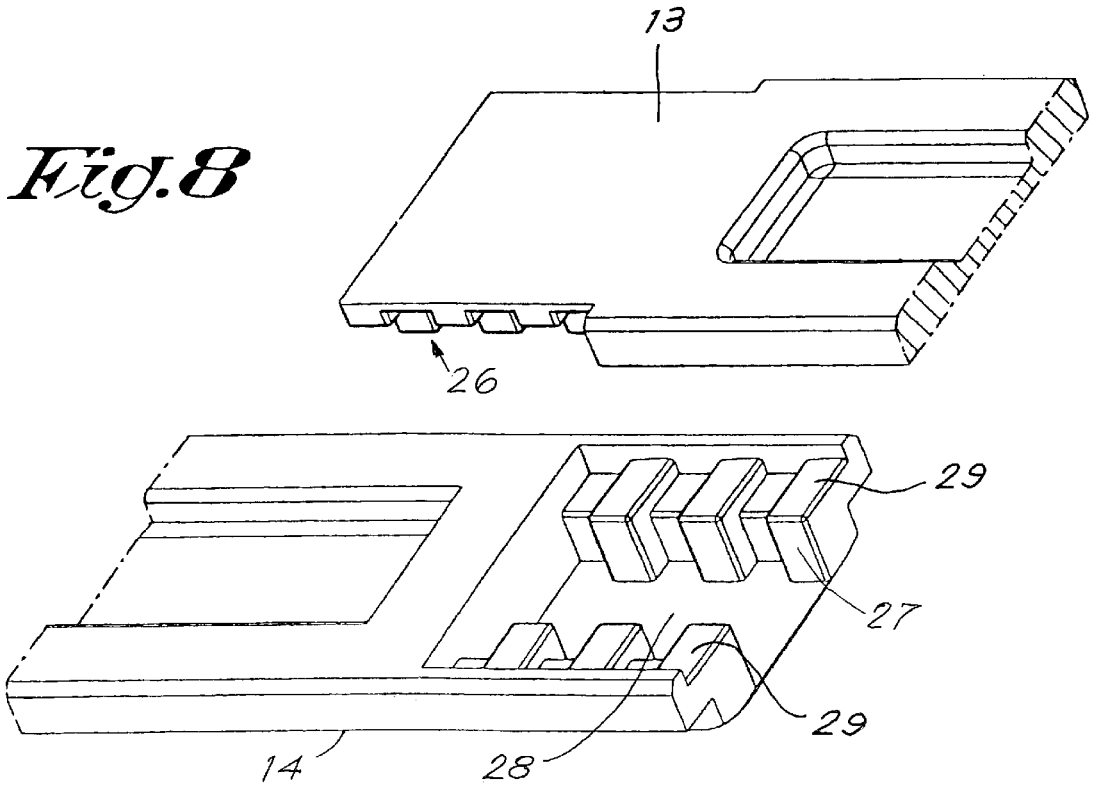

As represented in FIGS. 7 to 9, this toothed part 26 is exclusively provided in longitudinal edges of the extremity which, in width direction, is narrower and, starting from the bottom of the fitting groove 15, is less high. The teeth of the toothed part 26, however, protrude laterally as well as upward.

This toothed part 26 cooperates with a complementary toothed part 27 on an extremity of a connection lath, this is a lath 14. This complementary toothed part 27 is provided at the inner side of a somewhat thickened extremity 28, which is hollow at its underside, in the two lateral edges 29 thereof.

The toothed parts 26 and 27, which are considerably shorter than the toothed parts 22 and 25, do not serve for adjusting the length of the whole of laths along an edge, and during coupling, these toothed parts 26 and 27 overlap each other entirely.

The toothed parts 26 and 27 are engaged into each other before both laths 13 and 14 are slid into the fitting groove 15. Once slid therein, the toothed parts 26 and 27 form a solid coupling of a lath 13 with a lath 14.

The other extremity of the lath 14 comprises an extremity which has a shape similar to the extremity of the lath 13 with the toothed part 26 and which, thus, also comprises a toothed part 26.

Also the lower end of the movable part 5 of the uppermost corner connection 4 has a rigid extremity along the upstanding edge of the wing 2, which extremity is similar to an extremity 28 and, thus, has a toothed part 27 in which, thus, in a manner analogous to the one described in the aforegoing, a toothed part 26 of a lath 14 engages.

Between the lath 13 and said movable part 5, instead of one, several laths 14 may be provided successively, as well as the lath 13 with its toothed part 26 may engage directly into the toothed part 27 of this part.

Figure 10:
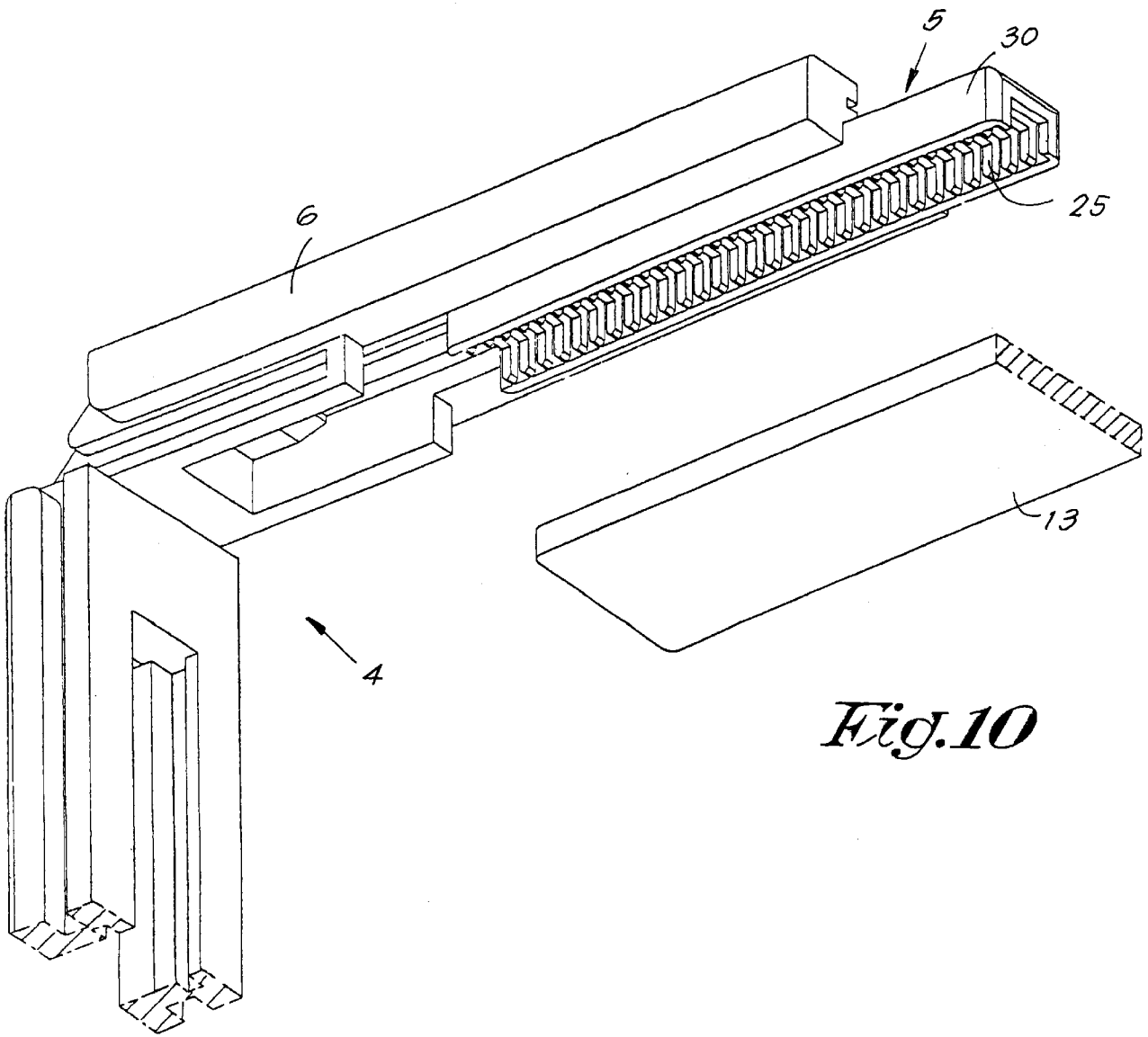
FIGS. 10 and 11 represent perspective views, viewed from the bottom, the top, respectively, of the ends of a corner connection and a lath at the upper side of the wing which have to be coupled.
Figure 11:
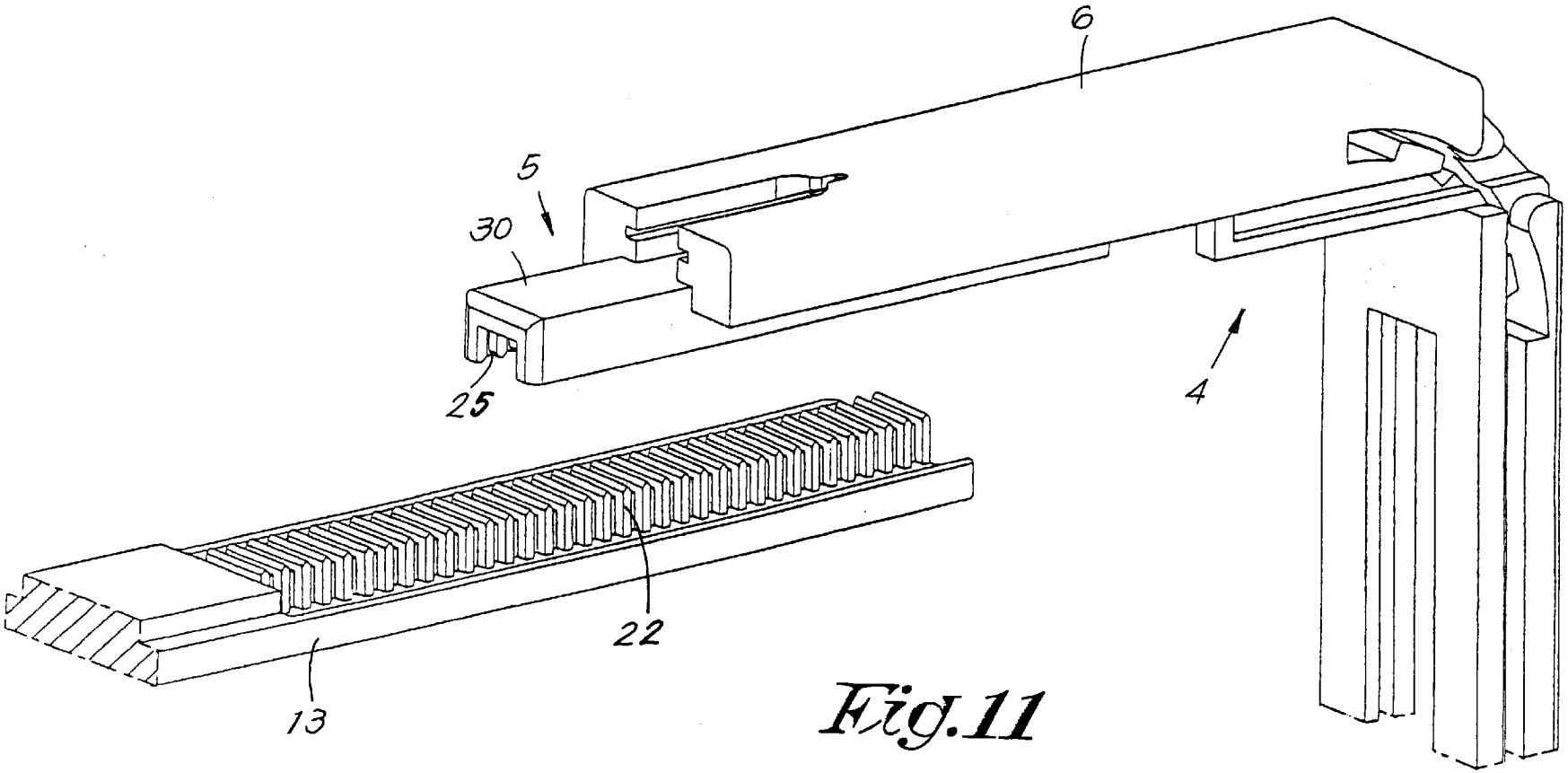

As represented in detail in FIGS. 10 and 11, the movable part 5 of the corner connection 4 comprises a second rigid extremity which is connected to said extremity by means of a band of spring steel and which is situated along the upper edge of the wing 2. This latter extremity consists of a gutter-shaped part 30 which is provided with a toothed part 25 at its interior side which is identical to the toothed part 25 in the carrier piece 3.

The toothed part 25 at said extremity of the part 5 engages into the toothed part 22 at one extremity of a lath 13 which is situated in the fitting groove 15 on the upper edge of the wing 2. By the last-mentioned toothed parts 22 and 25, the length of the fitting can be adjusted in the longitudinal direction of said edge by approximately five centimeters.

Said lath 13 engages with its toothed part 26 into the toothed part 27 of a lath 14, whereas the toothed part 26 of the last-mentioned lath 14 itself engages into a toothed part 27 which is provided on a second lath 14 or on an extremity of a lath 31 guided in the fitting groove 15 which extends underneath the scissors mechanism 7. This lath 31 is connected, by the intermediary of a lath 32, to an extremity of the movable part 5B of the corner connection 19.

The lath 32 is provided with locking parts 33 for blocking the main lever 34 of the scissors mechanism 7 which is attached to a part of the uppermost hinge 8.

The lath 32 has an extremity with a recess which engages on a block on the movable part 5B.

Along the upstanding edge of the wing 2, this movable part 5B of the corner connection 19 is provided with a toothed part 27 at its extremity, with which toothed part it engages over a toothed part 26 of an additional lath 14 which extends along this upstanding edge, and thus is connected to the lath 14 by a coupling, such as represented in FIG. 9. Several additional laths 14 are connected to each other by such mutually engaging toothed parts 26 and 27 along said edge.

Under the carrier piece 3, the lath 13 coupled to this part at the bottom engages with its toothed part 26 into the toothed part 27 of a lath 14. The toothed part 26 of this lath 14 in its turn engages into a toothed part 27 on the upper end of said lath 10 which is provided with a recess at the bottom and carries the hinge pin 9.

Said recess engages over a block which is provided on the movable part 5B of the corner connection 18 which is similar to the corner connection 19.

Finally, the toothed part 27 of this part 5B engages into the toothed part 26 of a lath 14 which can be shifted along the lower edge of the wing 2.

The laths 13 and/or 14 can be made of aluminum as well as of synthetic material, for example, polyamide, which is reinforced by fibers, for example, glass fibers. Also, certain parts, such as the carrier piece 3, the fixed part of the corner connections 4, 18 and 19 can be manufactured of such synthetic material. A suitable synthetic material consists of 66% polyamide en 30% glass fibers.

When the carrier piece 3 is pushed downward by the handle, the laths 13, 14, 10, 31 and 32 move and first the pins 17 are freed from the locking parts 17A, as a result of which the wing 2 can swing open.

With a further movement, whereas the wing 2 still is closed, the hinge pin 9 penetrates into the recess 11 of the ramp-forming part 12, and the cams 33 on the scissors mechanism 7 are set free, as a result of which the wing 2 can tilt.

When mounting the fitting on the wing 2, two toothed parts 26 and 27 to be connected first are brought into each other before the lath 13 or 14 or any part is slid into the fitting groove 15.

Finally, the carrier piece 3 is snapped into the vertical edge on the fitting groove 15, such that its toothed parts 25 engage with a number of teeth into the toothed part 22 of the two laths 13.

In FIGS. 12 to 17, a burglary-delaying form of embodiment of the fitting is represented.

This form of embodiment substantially differs from the form of embodiment described in the aforegoing, amongst others, in that the carrier piece 3 is realized heavier and no longer is coupled to the laths 13 by means of a toothed part, but by means of punching screws 35 and also is not snapped into the fitting groove 15, but slid therein.

Figure 12:
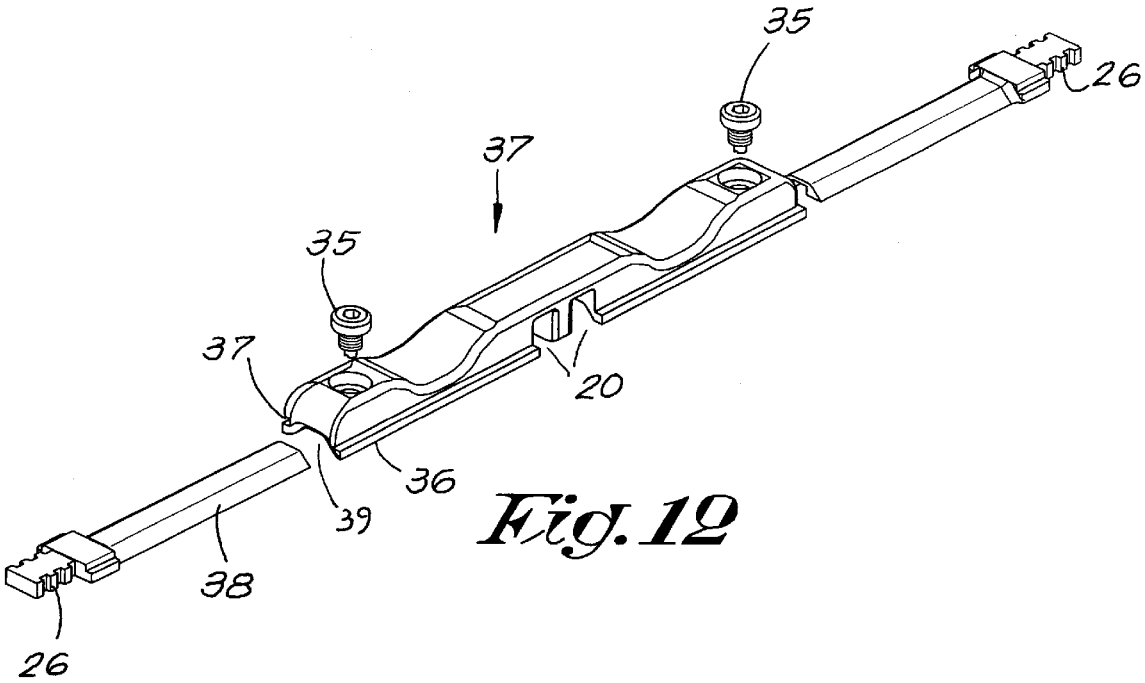
FIGS. 12 and 13 represent perspective views analogous to those of FIGS. 2 and 3, however, relating to another form of embodiment of the invention.
Figure 13:
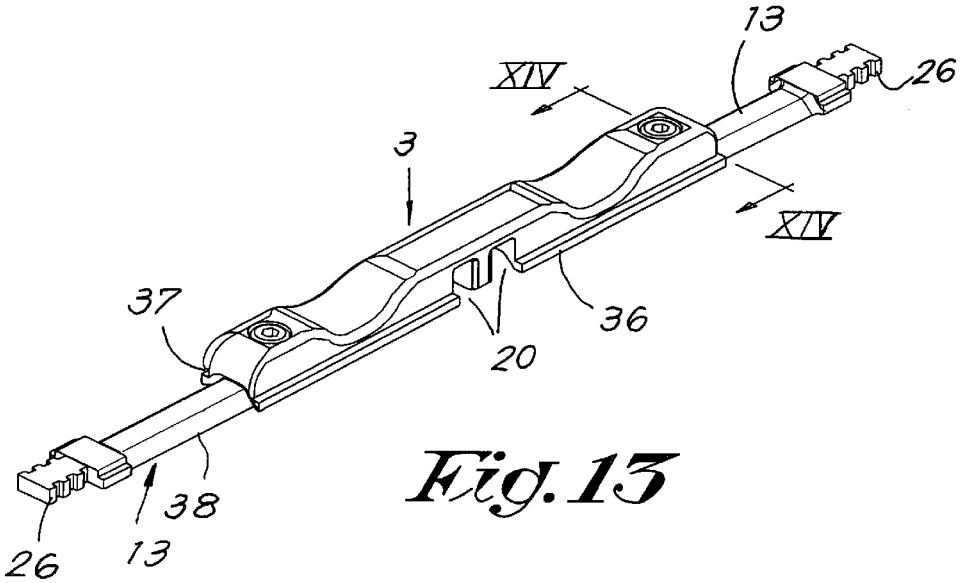
Figure 14:
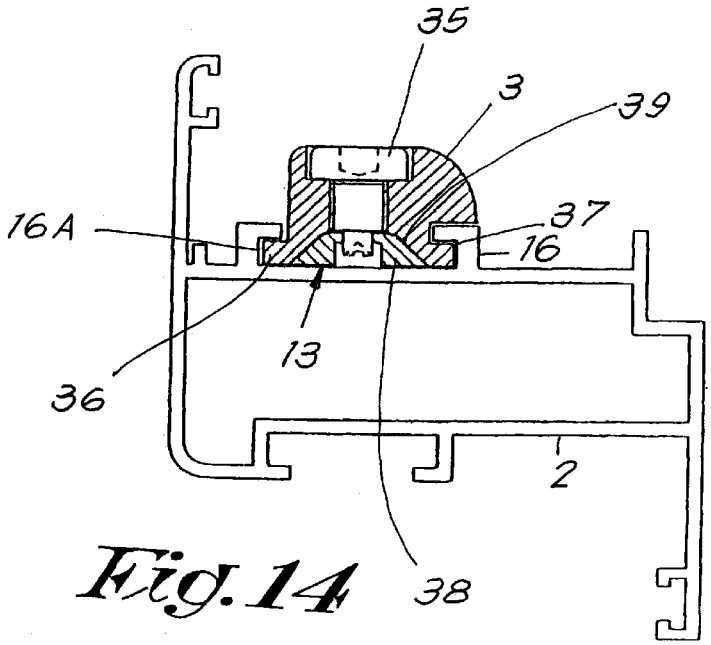
FIG. 14 represents a cross-section according to line XIV—XIV in FIG. 13 with a portion of the wing.

As represented in detail in FIGS. 12 to 14, the carrier piece 3 also is a block having two recesses 20, however, the springy legs are replaced by an outwardly directed rib 36 at one side, which is interrupted by the recesses 20 and shiftably fits into the groove 16A and a groove 37 at the other side, into which fits the bent edge of a rib 16 situated at this side.

Further, a punching screw 35 is screwed into each extremity of the carrier piece 3, which, with its point, has punched a hole into a narrowed, but not provided with a toothed part, flat extremity 38 of a lath 13. The lateral edges of this extremity 38 are beveled, and the carrier piece 3 is provided with a corresponding recess 39 at its underside, which underside is directed towards these extremities 38.

The extremities 38 are relatively long, but the piece with a T-shaped cross-section of a lath 13 is extremely short, just sufficient for slidably retaining this lath 13 in a fitting groove 15.

In this embodiment, the laths 13 are only slid with their extremity 38 underneath the extremities of the carrier piece 3 after this latter, too, has been slid into the fitting groove 15. When the extremities 38 are situated at the desired location, the punching screws 35 are screwed tight, such that they punch a hole through the extremities 38 in which they remain as connection pins. Therefore, the mounting and also the manufacturing of the carrier piece 3 is simple. It offers an excellent protection of the fork of the handle against deformation by a screwdriver of a burglar.

Possibly, in this burglary-delaying form of embodiment all laths 13, 14 consist of aluminum, and the toothed parts 25, 26 and 27 can be made more solid.

Figure 15:
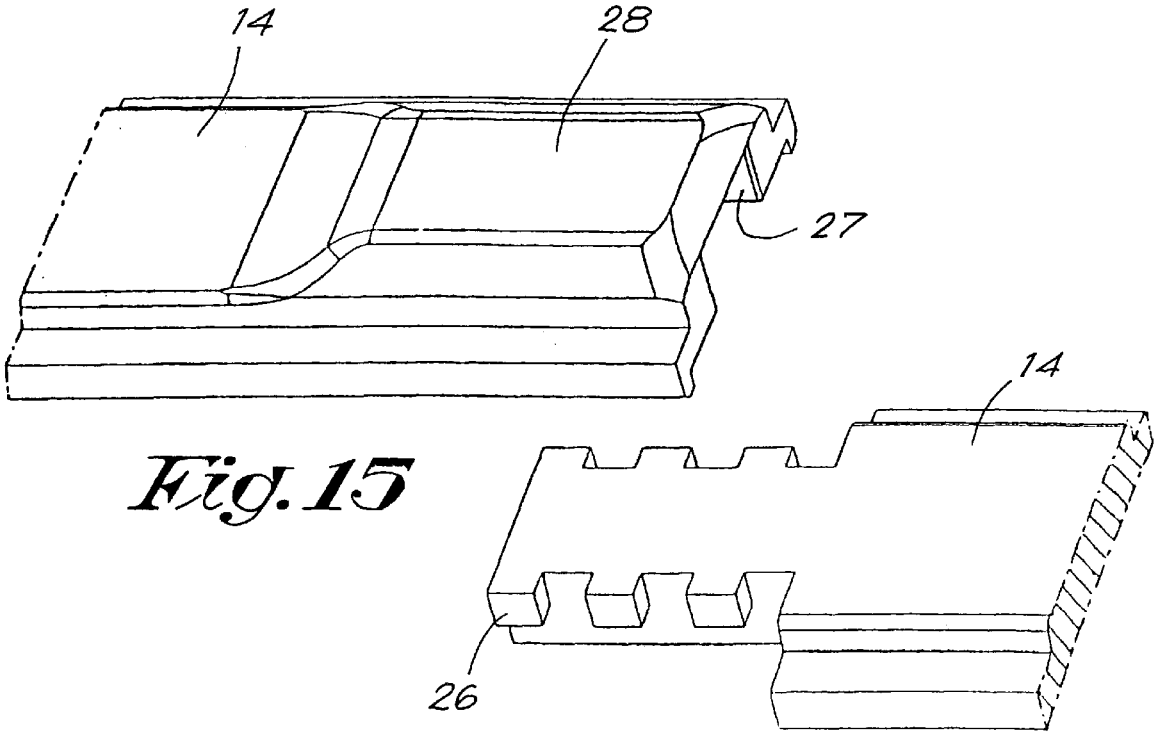
FIG. 15 represents a perspective view analogous to that of FIGS. 7 and 8 of a same coupling of two adjacent laths, however, relating to another form of embodiment;.

So, especially the end of the laths 13 and 14, provided with a toothed part 26, can be more narrow, whereas the toothed part 26 only has teeth on the lateral edges, such as represented in FIG. 15. The toothed part 27 cooperating with this toothed part 26 is unaltered in respect to the form of embodiment represented in FIGS. 7 and 8.

Figure 16:
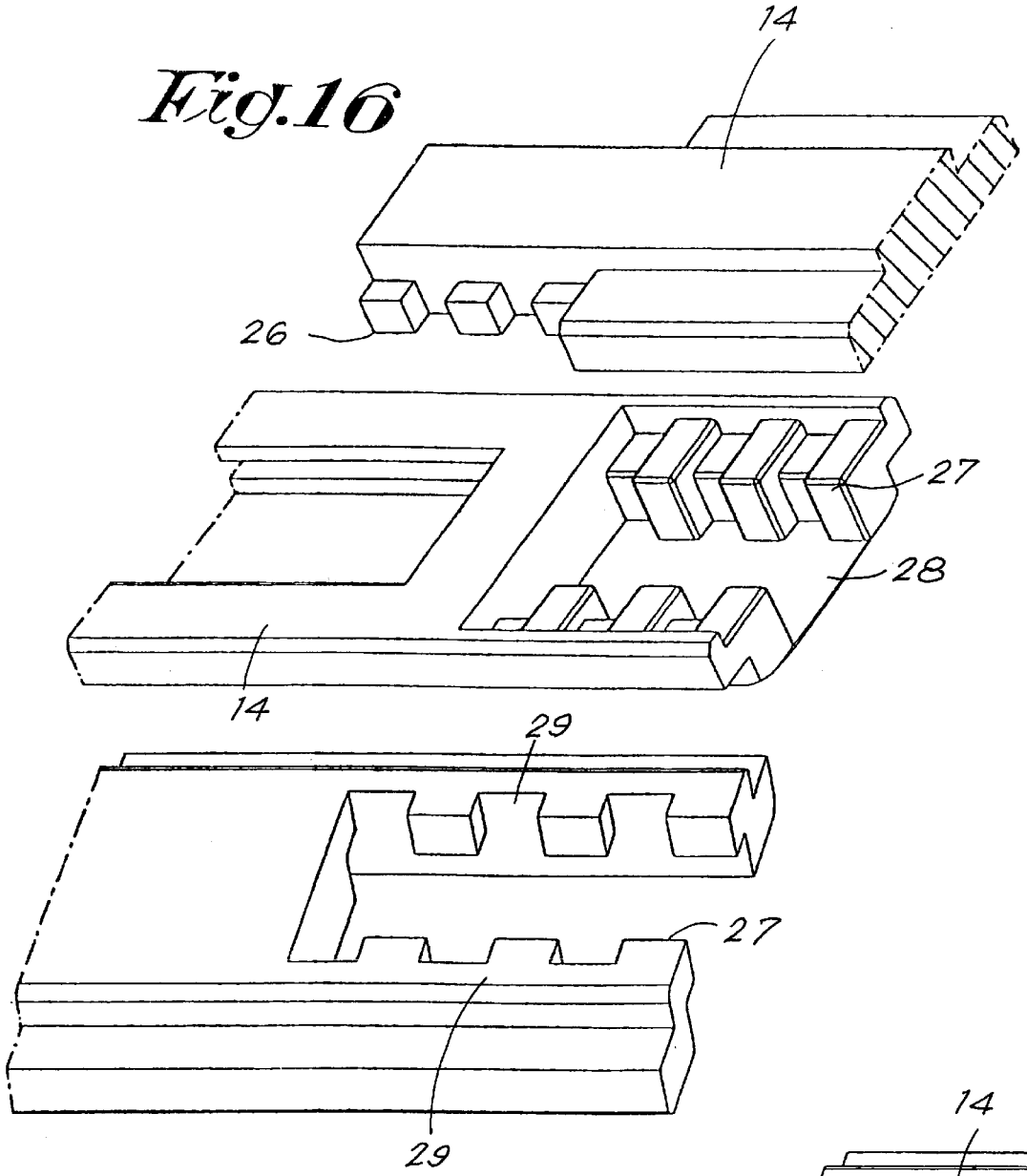
FIGS. 16 and 17 represent perspective views analogous to that of FIG. 15, however, relating to another forms of embodiment of the coupling.

Still another embodiment of a coupling between a toothed part 26 and a toothed part 27 is represented in FIG. 16. The toothed part 26 also only comprises teeth on the lateral edges. The hollowed extremity 28 with the toothed part 27 does not have to be thickened, as it was in the preceding forms of embodiment.

Figure 17:
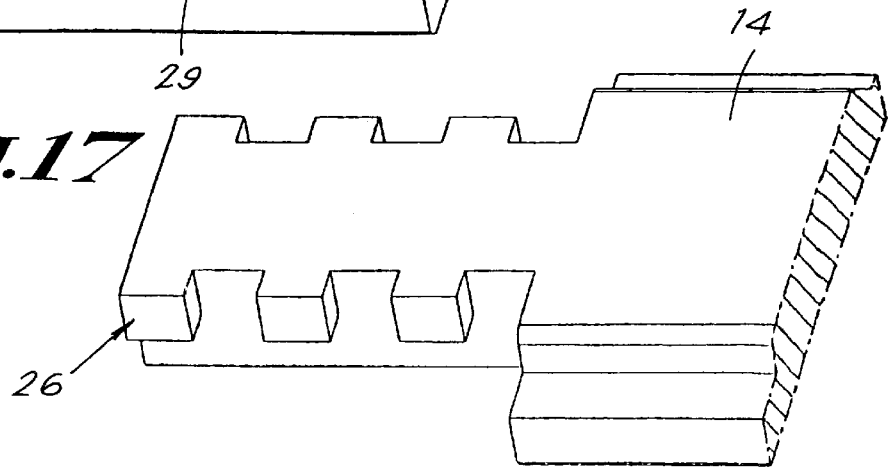

Still another embodiment of the coupling is represented in FIG. 17. The toothed part 26 also only has teeth on the lateral edges, however, these are situated at a distance from the underside. The extremity 28 with the toothed part 27 also is not thickened and solely consists of the two lateral edges 29.

Whereas in the aforegoing, only two types of laths 13 and 14 are described, it is obvious that other types are possible, too, such as laths having at both extremities an extremity 28 with a toothed part 27, for example, laths with a pin 17 thereupon, and laths having a toothed part 26 at both extremities. It is substantial that each time a toothed part 26 and a toothed part 27 can mutually engage in order to form a coupling.

Also, laths may be present which have a toothed part at only one extremity, for example, laths which are situated at the extremity of a connection or form part of one or the other mechanism.

Certain types of laths can not comprise any pins 17, whereas others, for example, may comprise more than one pin 17.

It is clear that the carrier pieces 3 and laths 13 and 14 described heretofore also can be applied with other windows than turn and tilt windows, whereby these parts can be mounted on the wing as well as on the fixed window. Parts, such as the scissors mechanism 7 or the hinge pin 9, are not present.

If these parts only extend along an edge, then a precise length adjustment may not be necessary, however, the parts described in the aforegoing allow for a simple, fast and inexpensive mounting, without sawing or previous boring or punching.

With such other windows, also corner connections 4 and/or 18 and/of 19 may be used.

Figure 18:
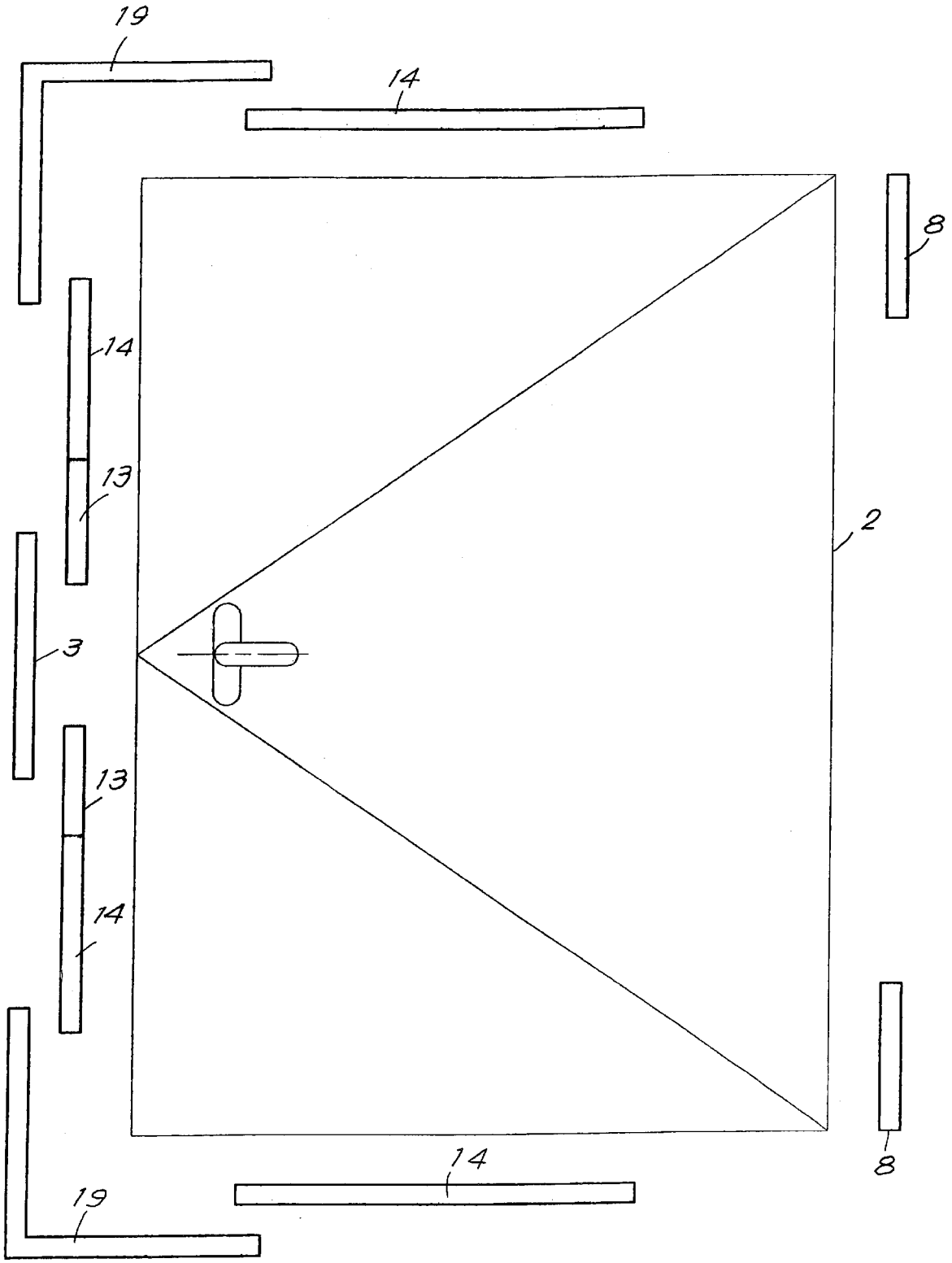
FIG. 18 schematically represents a turning window with the parts of the fittings therefor.

In FIG. 18, very schematically a turning window is represented, whereby the parts of the fitting are indicated with the same reference ciphers as in the preceding figures.

Figure 19:
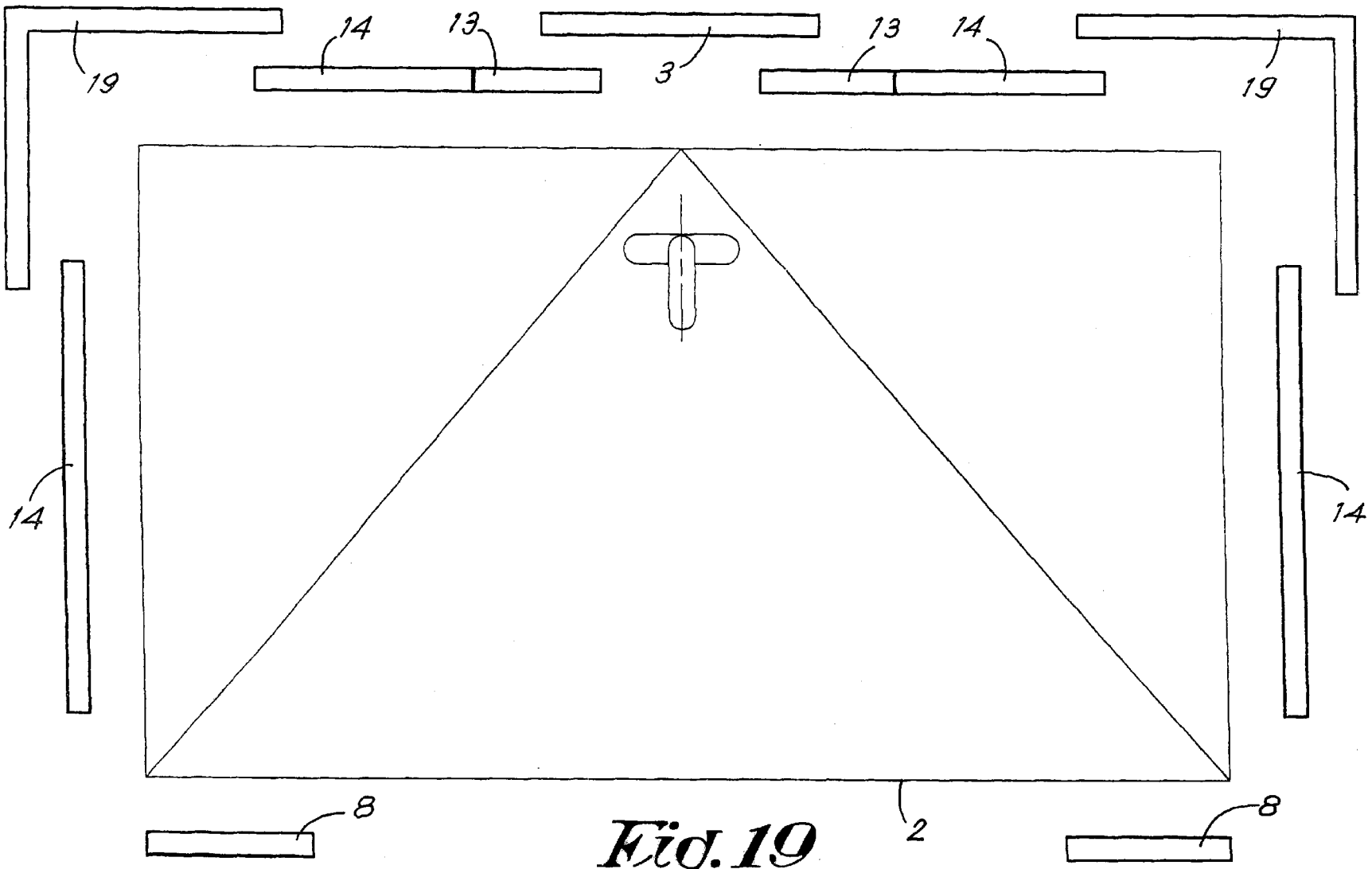
FIGS. 19 and 20 schematically represent two embodiments of a sash window, with indication of the parts of the fittings.
Figure 20:
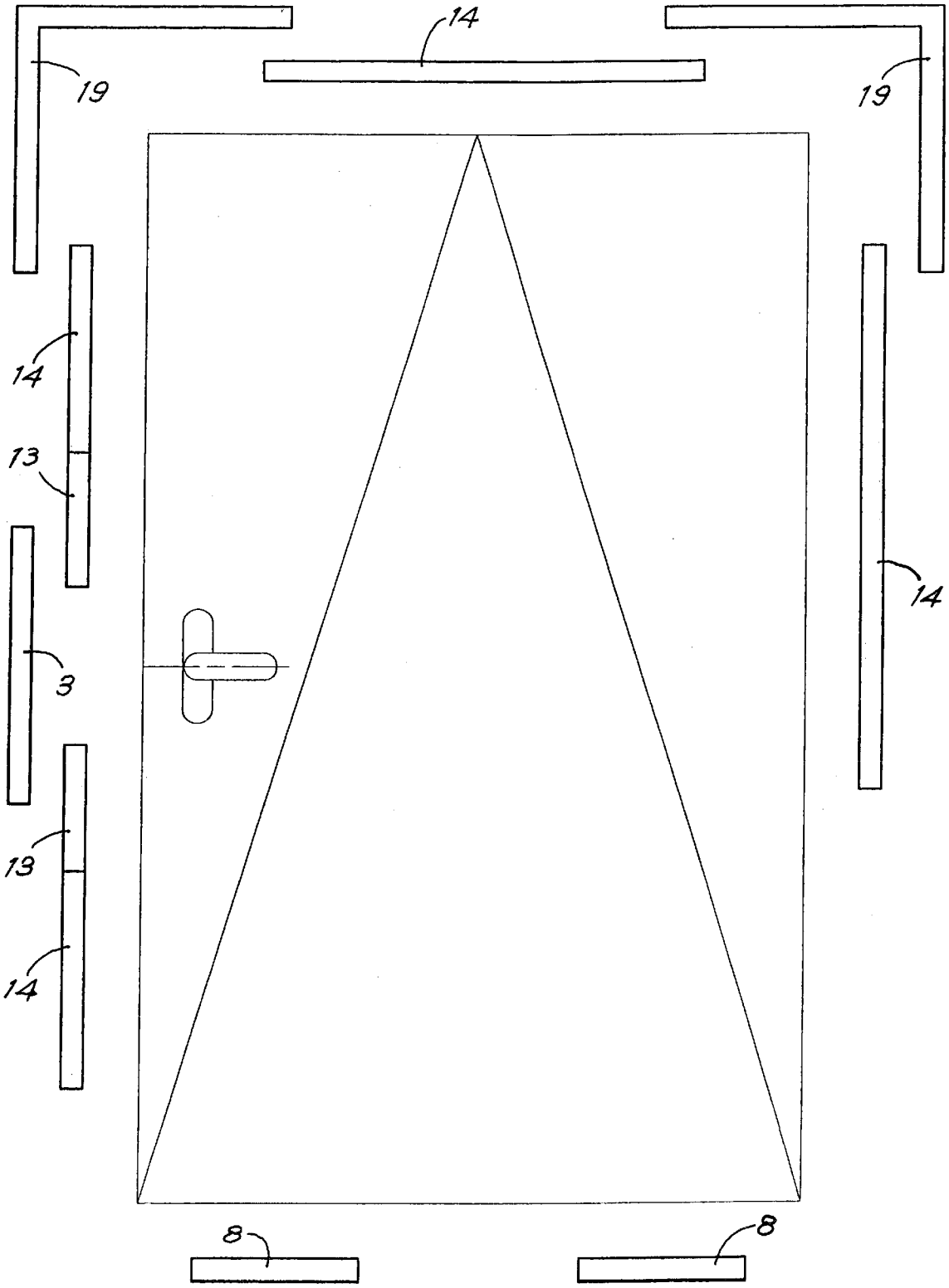

In FIGS. 19 and 20, in an analogous manner, two embodiments of a top-hung window are represented.

Figure 21:
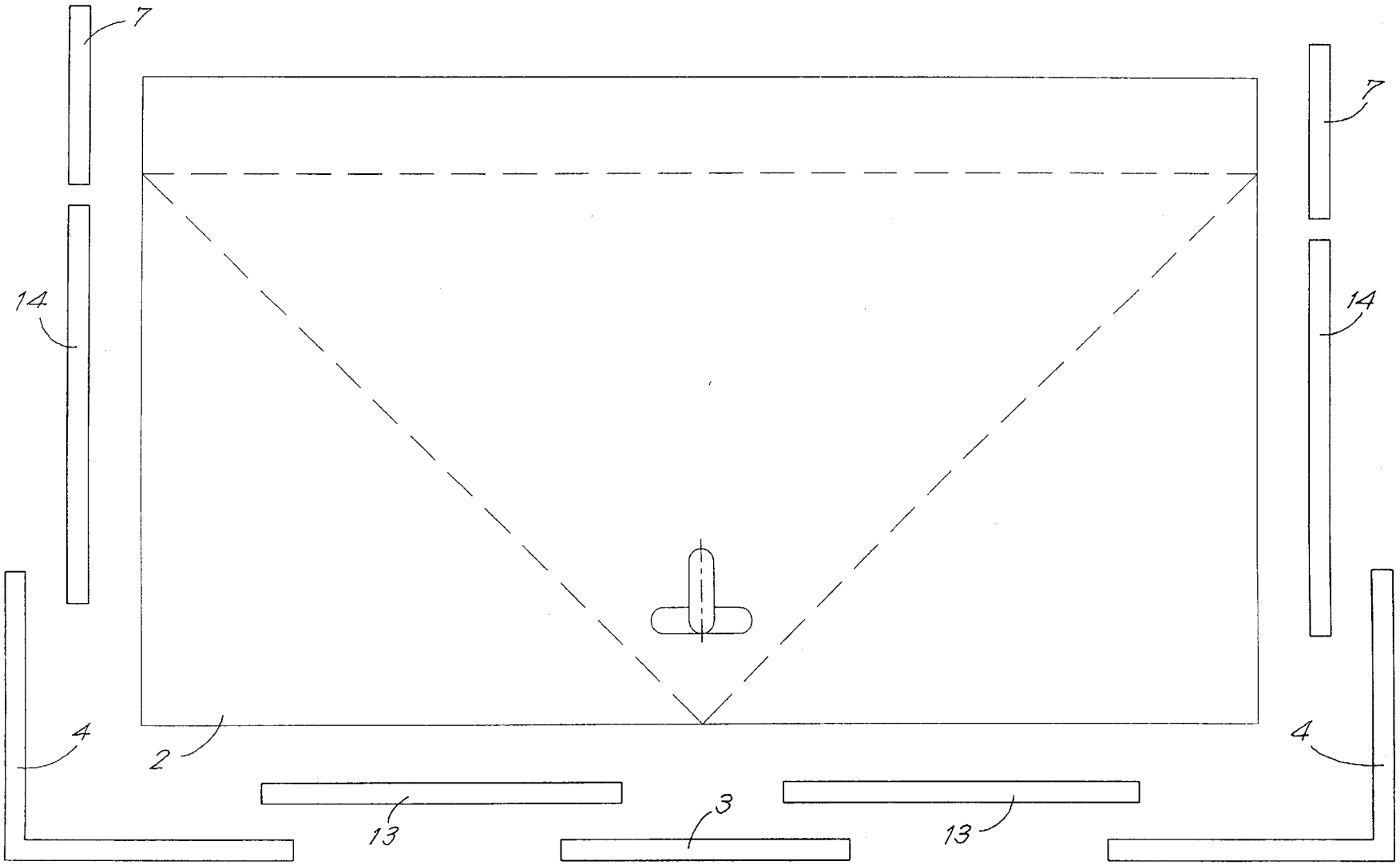
FIG. 21 schematically represents a projecting window with indication of the parts of the fitting according to the invention.

In FIG. 21, also in an analogous manner, schematically a projecting window is represented. The wing 2 is attached at the fixed frame 1 at the top at opposite sides, by means of a scissors mechanism 7.

In FIG. 22, in an analogous manner a pivot-hung window is represented, whereby the wing 2 at opposite sides, at half of its height, is hinging around a horizontal axis in respect to the fixed frame 1.

In some of these windows, such as with the turn and tilt window described in the aforegoing, the fitting also may comprise ramp-forming parts 12, possibly without recesses 11 or with a recess 11 which is not used.

With any type of window where a ramp-forming part 12 is attached to the fixed frame 1, in a particular form of embodiment of the invention this ramp-forming part 12 can be snapped into a fitting groove 40 on the edge of the fixed frame 1. This ramp-forming part 12 preferably is manufactured of synthetic material, for example, polyamide, possibly reinforced by fibers, such as glass fibers.

As represented in detail in FIGS. 23 to 27, this ramp-forming part 12 comprises an elongated block which, at one longitudinal side, is provided with a groove 41, whereas at the opposed side, it comprises a springy leg 42 having an outwardly directed edge 42A.

Figure 26:
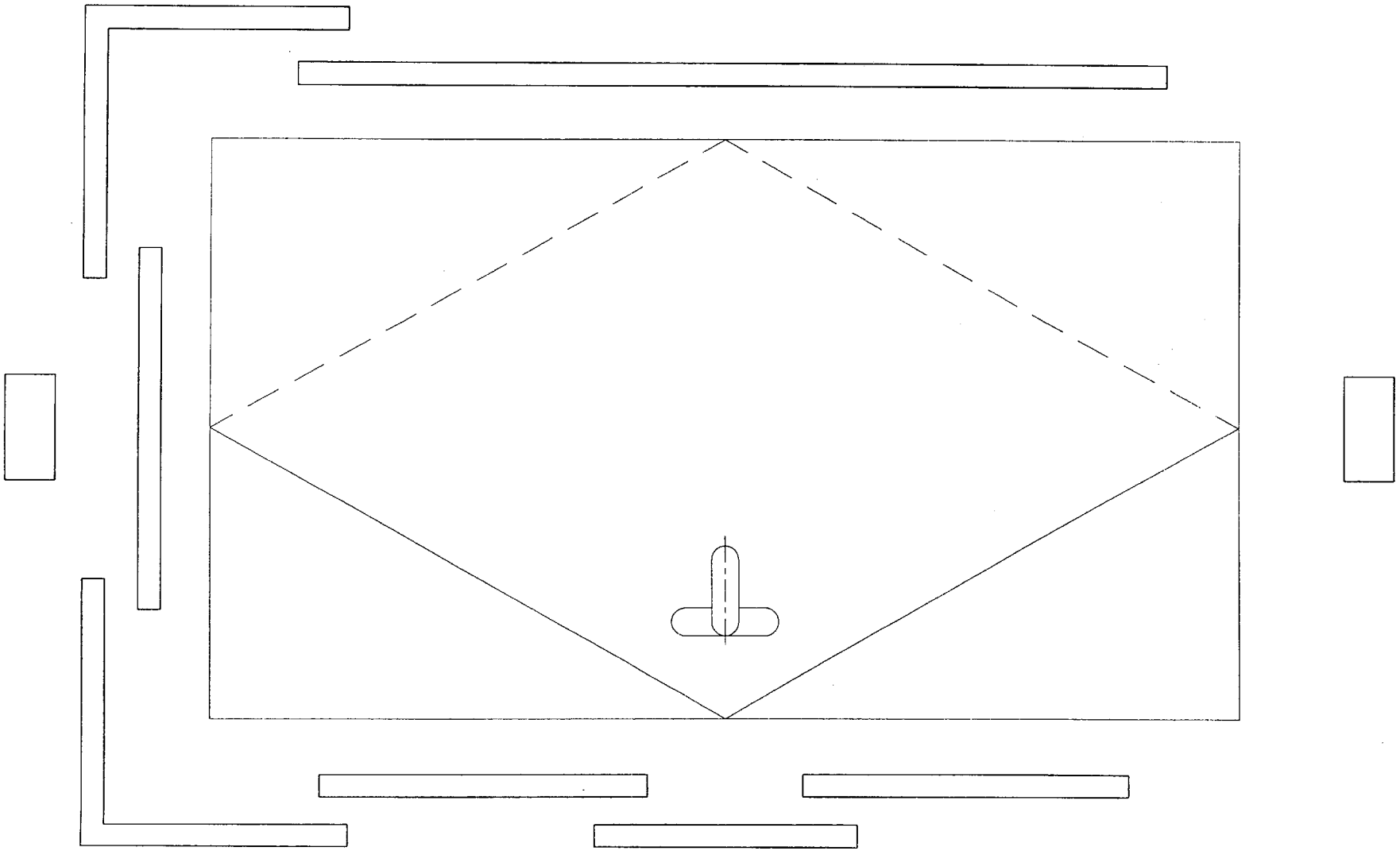
FIGS. 25 to 27 represent cross-sections according to lines XXV—XXV, XXVI—XXVI and XXVII—XXVII in FIG. 23, however, with a portion of the fixed frame.
Figure 23:
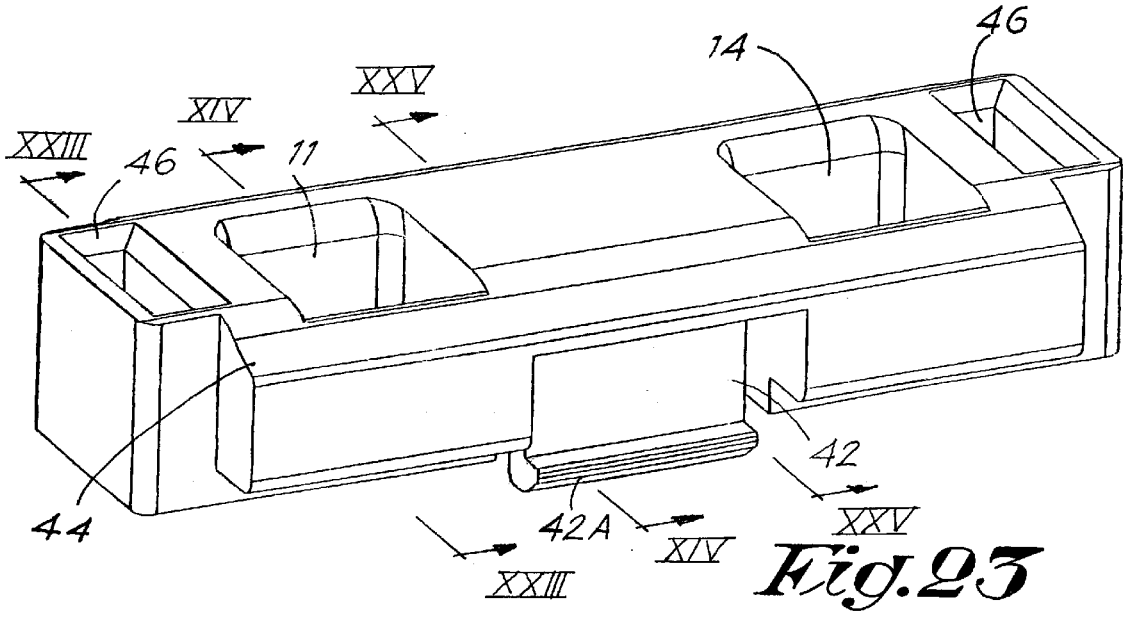
FIGS. 23 and 24 represent perspective views of the ramp-forming block of the aforementioned fitting, viewed from the top, the bottom, respectively.
Figure 24:
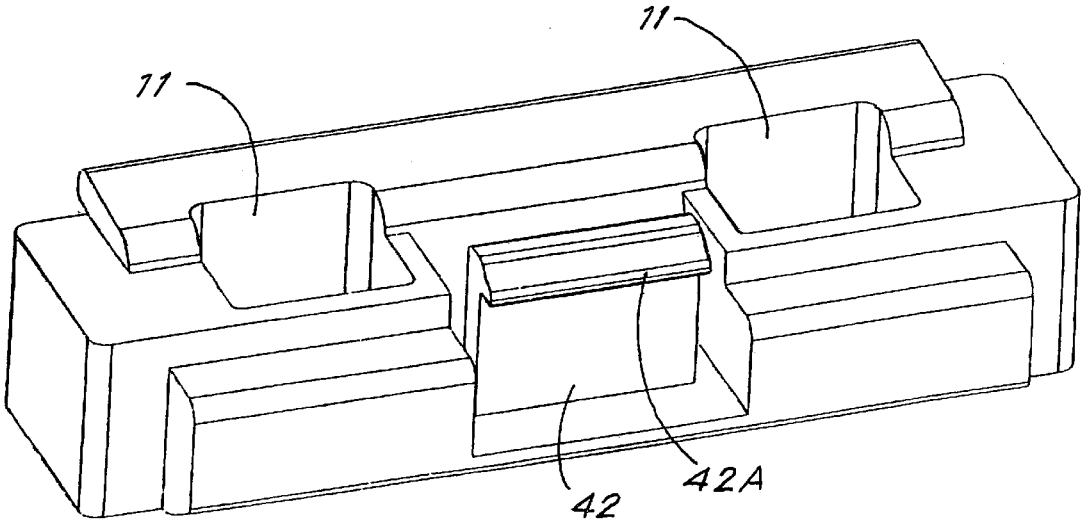
Figure 25:
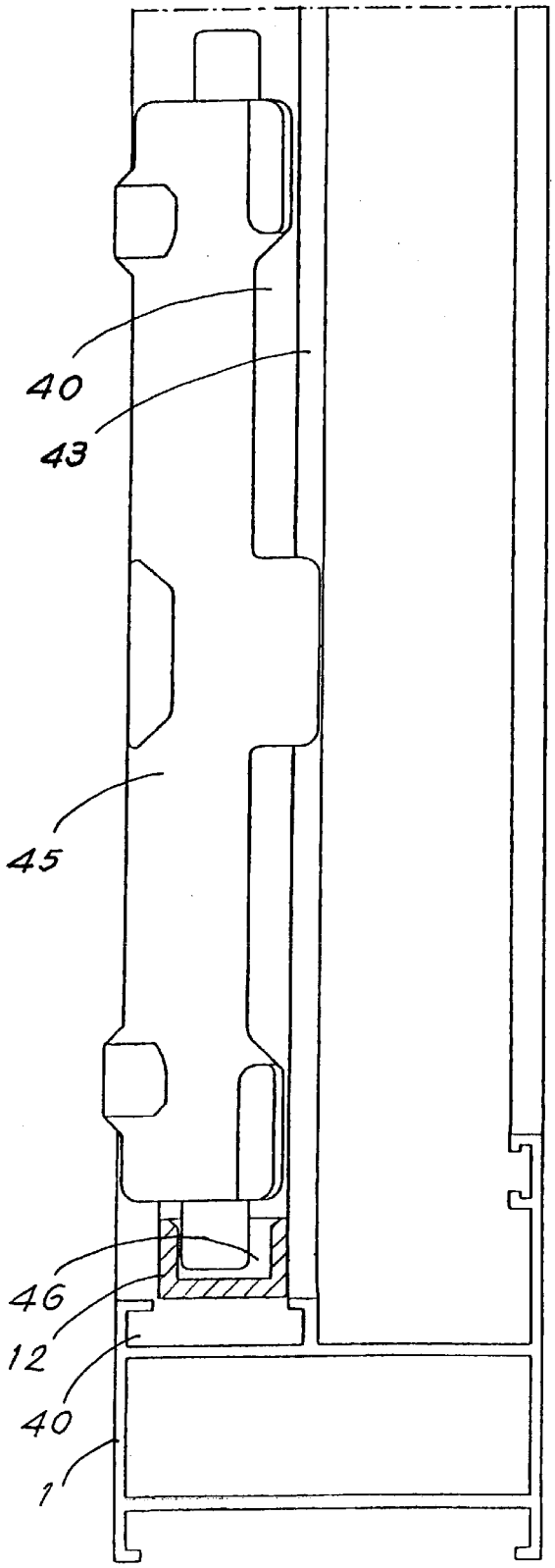
Figure 26:
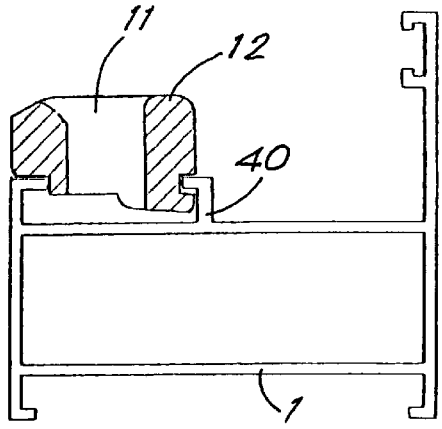
Figure 27:
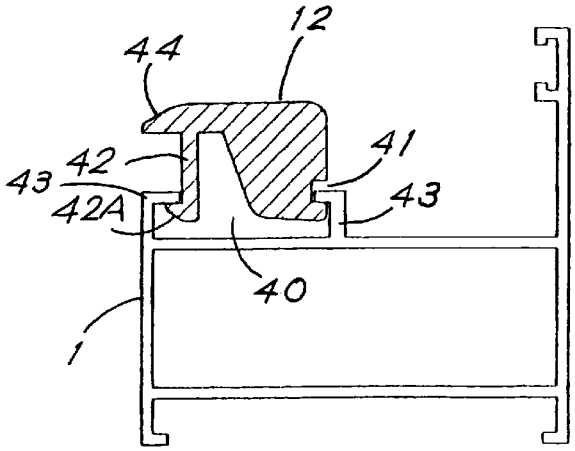
Figure 28:
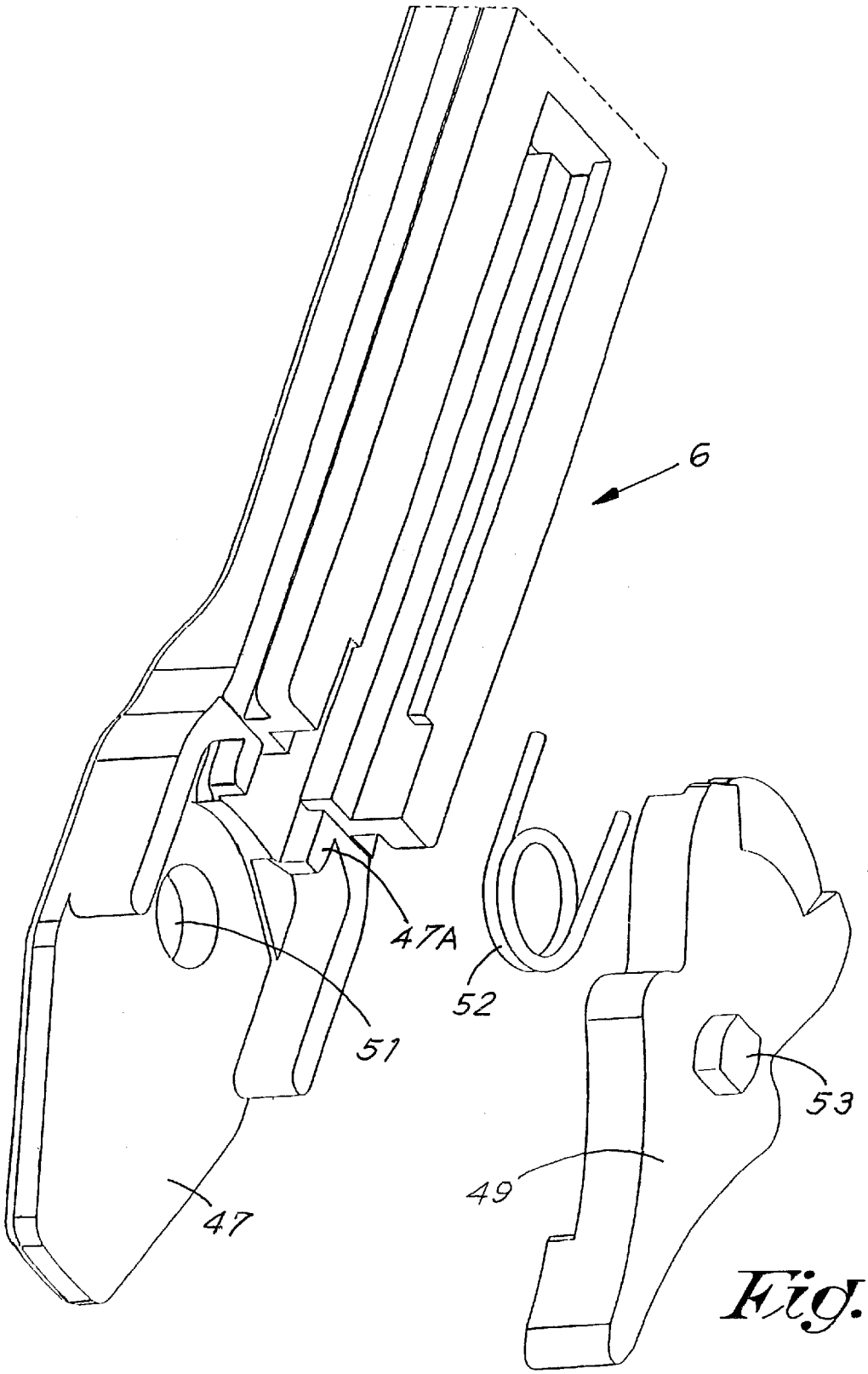
FIGS. 28 and 29 represent perspective views of a securing system with the elements thereof in disengaged condition.
Figure 29:
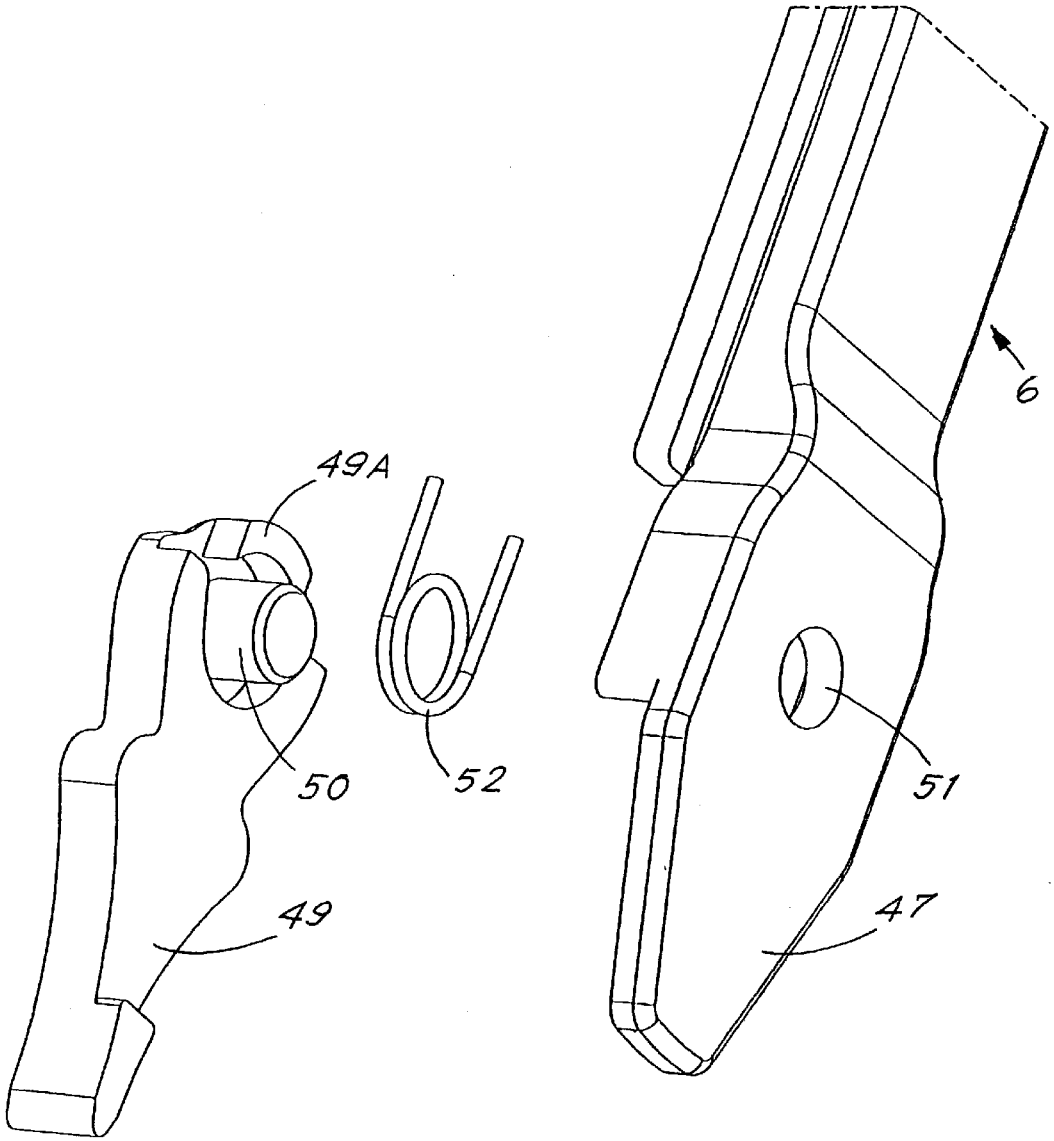

As represented in detail in FIGS. 26 and 27, the ramp-forming part 12 is slid with its groove 41 over the bent edge of one of the ribs 43 limiting the fitting groove 40, whereas the edge 42A of the leg 42, by springy deformation of this latter, is snapped under the bent edge of the other rib 43 and engages.

At the top, at the side of the leg 42, this is also the side along which the wing 2 swings open, the ramp-forming part 12 is provided with an ramp-like plane or bevel 44.

When closing the wing 2, this bevel cooperates with the fixed part 6 of the corner connection 18 in order to place the wing 2 in closed condition into the right position in respect to the fixed frame 1 in order to be able to realize a good closure.

If no corner connection 18 is present, on the wing 2 a complementary ramp-forming part can be snapped into the fitting groove 15 in a similar manner.

The ramp-forming part 12 is provided against the upstanding edge of the fixed frame 1, and in order to prevent that it might shift in its longitudinal direction over the horizontal edge of the frame 1, it is retained at its place by a locking part 45 which is attached to the first-mentioned upstanding edge and with which cams standing on the lath 10 cooperate. With its lower extremity, the locking part 45 sits in an opening 46 at an extremity of the ramp-forming part 12, such as represented in detail in FIG. 23.

For enabling its use with wings 2 turning to the right as well as such turning to the left, the ramp-forming part 12 is symmetrical and has such an opening 46 in its upper side at each extremity.

Therebetween, the ramp-forming part is provided with two recesses 11. When the carrier piece 3 is placed into tilting position, the hinge pin 9 penetrates into one of these recesses 11 and hinges in this recess 11 during tilting.

With a turn and tilt window, at the fixed part 6 of the corner connection 4, a securing system is provided which prevents that, when the wing 2 is not closed, the system of laths 10, 13, 14, 31 and 32 is displaced by the carrier piece 3.

Figure 30:
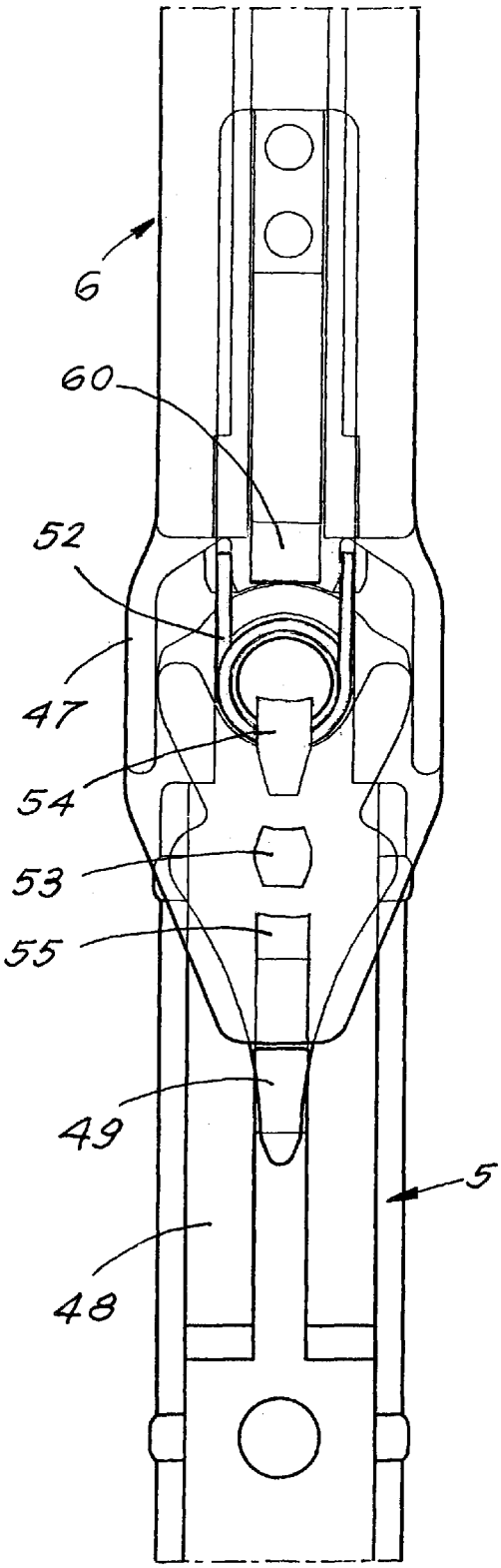
FIGS. 30 and 31 represent a view perpendicular to the edge of the wing on the securing system of FIGS. 28 and 29, in locked and unlocked condition, respectively.
Figure 31:
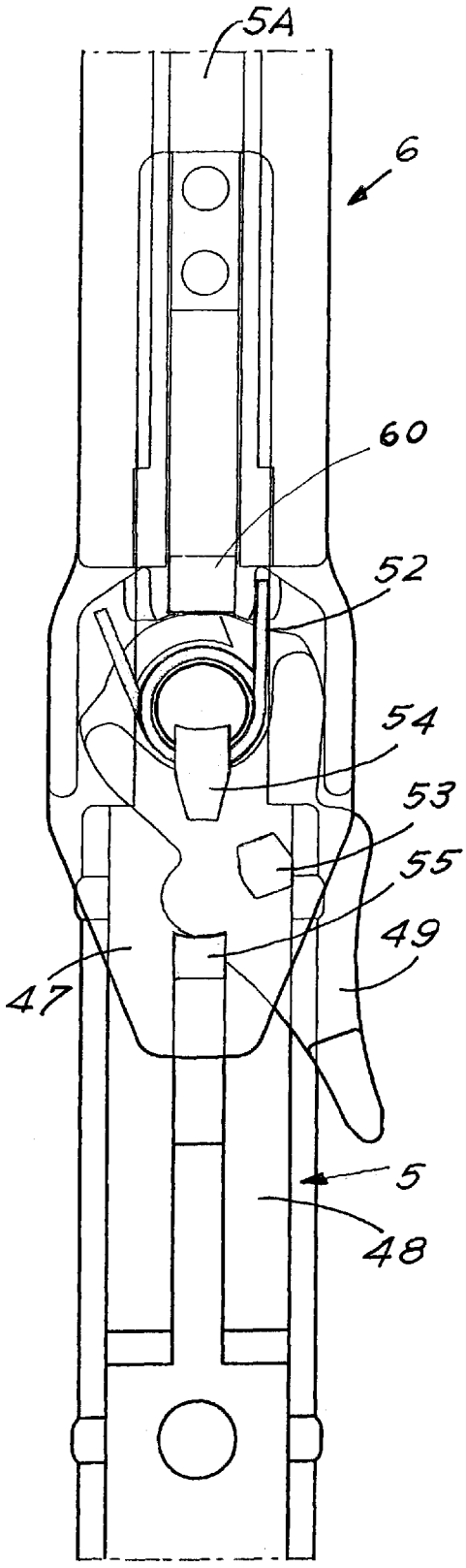

To this aim, the leg, of the fixed part 6 which extends along the upstanding edge of the wing 2 comprises a protruding head part 47 which extends at the exterior side at a distance from the rigid extremity 48 of the movable part 4, which extremity is attached to a band 5A made of spring steel. This movable part 5 is represented in FIGS. 30 and 31 only.

At the side of the extremity 48, at the head part 47 a more or less triangular lever 49 is provided in a pivotable manner. To this aim, this lever 49 is provided with a pin 50 at one side which sits turnably in an opening 51 in the head part 47. The lever 49 is seated between the head part 47 and the rigid extremity 48 of the movable part 5.

The pin 50 is surrounded by a countersunk spring 52, the legs of which extend at opposite sides of a part 49A of the lever 49 and are situated with their extremities at opposite sides of parts 47A of the head part 47, in such a manner that the spring 52 pushes the lever 49 always towards the position wherein the point of the lever 49 is directed downward. In FIG. 30, the lever 49 is represented in this position.

At the side of the lever 49 directed towards the extremity 48, at a distance from the turning axis formed by the pin 50, there is a locking pin 53.

As represented in FIGS. 30 and 31, the extremity 48 of the movable part 5 is provided with locking pins 54, 55 and 60 situated at a small distance from each other, which pins are directed towards the lever 49 and, for said position, represented in FIG. 30, of this lever 49, are situated above, below, respectively, the locking pin 53.

Under the influence of the spring 52, the lever 49 automatically takes the aforementioned position when the wing 2 is turned or tilted open. In that the locking pin 53 is situated between the locking pins 54 and 55, the extremity 48 only can be shifted over a distance of approximately 3 mm.

When the wing 2 is turned or tilted closed, the extremity of the lever 49 comes into contact with a stop which is attached to the fixed frame 1, as a result of which it is turned. In closed condition of the wing 2, the lever 49 is in the position represented in FIG. 31, whereby the locking pin 53 is outside of the path of the locking pins 54 and 55, such that the extremity 48 can be shifted.

As the pin 50 is provided on the lever 49, the mounting of the securing system is rather simple.

First, the spring 52 is put into the lever 49, after which the lever 49 with the spring 52 is placed against the head part 47, whereby the pin 50 penetrates into the opening 51. Finally, the movable part 5 is slid into the fixed part 6.

The invention is in no way limited to the forms of embodiment described in the aforegoing and represented in the figures, on the contrary may such fitting and such parts for such fitting be realized in different variants, without leaving the scope of the invention.

What is claimed is:

1. A window fitting for a window having a fixed frame and a wing hingedly connected to at least one upright side of the fixed frame, said fitting comprising:

at least one carrier piece cooperating with an edge of the wing and an edge of the fixed frame, and positioned in a fitting groove defined by the wing;

a plurality of laths engaging said carrier piece in a shiftable fashion along an edge of the wing;

wherein at least two of said laths include a locking pin cooperating with a locking part provided by the frame and a locking part provided by said wing;

wherein said carrier piece at each end portion thereof defines a toothed profile configured and dimensioned to mutually engage a toothed profile defined at an end portion of each of said laths; and wherein said fitting extends over at least two edges of the window and includes a corner connection having a fixed part and a movable part therein, at least one end portion of the movable part defining a toothed profile configured and dimensioned to mutually engage the toothed profile of one of said laths in the fitting groove.

2. A window fitting for a window having a fixed frame and a wing hingedly connected to at least one upright side of the fixed frame, said fitting comprising:

at least one carrier piece cooperating with an edge of the wing and an edge of the fixed frame, and positioned in a fitting groove defined by the wing;

a plurality of laths engaging said carrier piece in a shiftable fashion along an edge of the wing;

a corner connection having a fixed part and a movable part therein, said corner connection positioned above said carrier piece and including a securing system arranged to prevent shifting of the carrier piece when said window is turned or tilted open, said securing system including a lever hingedly attached on a head part defined at one end of the fixed part of the corner connection and including a locking pin and a connecting pin having a spring disposed thereon, said head part defining an opening at an end portion directed towards the movable part of the corner connection, said connecting pin of said lever extending through said opening;

wherein said locking pin of said lever is positioned between at least two locking pins of said movable part when said wing is open relative to said fixed frame, and said locking pin of said lever is positioned obliquely relative to said at least two locking pins of said movable part when said wing is closed, said spring cooperating with said fixed part to urge said locking pin of said lever oblique relative to the locking pins of said movable part; and wherein said carrier piece at each end portion thereof defines a toothed profile configured and dimensioned to mutually engage a toothed profile defined at each end portion of said laths.

3. A window fitting for a window having a fixed frame and a wing hingedly connected to at least one upright side of the fixed frame, said fitting comprising:

at least one carrier piece cooperating with an edge of the wing and an edge of the fixed frame, and positioned in a fitting groove defined by the wing, said carrier piece including a rib disposed on one side thereof and a groove disposed along another side thereof and shiftably provided over and under, respectively, an edge of the fitting groove;

a plurality of laths engaging said carrier piece in a shiftable fashion along an edge of the wing;

wherein at least two of said laths include a locking pin cooperating with a locking part provided by the frame; and wherein said carrier piece at each end portion thereof is coupled to an end portion of one of said laths by a punching screw, said lath being positioned in the fitting groove under the end portion of the carrier piece.

4. The window fitting according to claim 3, wherein said fitting extends over at least two edges of the window and includes a corner connection having a fixed part and a movable part therein, at least one end portion of the movable part defining a toothed profile configured and dimensioned to mutually engage a toothed profile defined at an end portion of one of said laths in the fitting groove.

5. The window fitting according to claim 3, further comprising a corner connection having a fixed part and a movable part therein, said corner connection positioned above said carrier piece and including a securing system arranged to prevent shifting of the carrier piece when said window is turned or tilted open, said securing system including a lever hingedly attached on a head part at an end portion of the fixed part of the corner connection and including a locking pin and a connecting pin having a spring disposed thereon, said head part defining an opening at a side directed towards the movable part of the corner connection, said connecting pin of said lever extending through said opening;

wherein said locking pin of said lever is positioned between at least two locking pins of said movable part when said wing is open relative to said fixed frame, and said locking pin of said lever is positioned obliquely relative to said at least two locking pins of said movable part when said wing is closed, said spring cooperating with said fixed part to urge said locking pin of said lever oblique relative to said locking pins of said movable part.

6. A window fitting for a window having a fixed frame and a wing hingedly connected to at least one upright side of the fixed frame, said fitting comprising:

at least one carrier piece cooperating with an edge of the wing and an edge of the fixed frame, and positioned in a fitting groove defined by the wing, said carrier piece including a rib disposed on one side thereof and a groove disposed along another side thereof and shiftably engages an edge of the fitting groove.

a plurality of laths engaging said carrier piece in a shiftable fashion along an edge of the wing;

wherein at least two laths include a pin cooperating with a locking part connected to the fixed frame and the wing, said locking part includes a ramp-forming part attached to the fixed frame and having at least one springy leg engaging a first small edge defined by one side of the fitting groove on the fixed frame, said ramp-forming part having a groove configured and dimensioned to engage another small edge defined by another side of the fitting groove.

7. The window fitting according to claim 6, wherein the ramp-forming part is manufactured of synthetic material selected from the group consisting of polyamide and glass fibers.

8. The window fitting according to claim 6, further comprising a secondary locking part attached to an upstanding edge of the fixed frame and positioned with a lower end thereof in an opening defined by the ramp-forming part to thereby prevent movement of the ramp-forming part.

9. The window fitting according to claim 6, wherein said fitting is provided on a turn and tilt window.

10. The window fitting according to claim 6, wherein said ramp-forming part defines at least one recess configured and dimensioned to receive a portion of a movable hinge pin coupled to the carrier part and the laths.

* * * * *